US006206304B1

(12) United States Patent
Koseki et al.

(10) Patent No.: US 6,206,304 B1
(45) Date of Patent: Mar. 27, 2001

(54) INJECTOR

(75) Inventors: Yukio Koseki, Susono; Keiso Takeda, Mishima; Tomojiro Sugimoto; Hisato Hirooka, both of Susono; Minoru Ogawa, Toyota; Yasuhiro Yamamoto, Chiryu, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/480,557

(22) Filed: Jan. 10, 2000

(30) Foreign Application Priority Data

Jan. 13, 1999 (JP) ..... 11-006160
Jul. 6, 1999 (JP) ..... 11-191645
Oct. 5, 1999 (JP) ..... 11-283923

(51) Int. Cl.[7] ..... F02M 61/00; F02M 59/00; B05B 1/30

(52) U.S. Cl. ..... 239/533.12; 239/533.2; 239/581.1

(58) Field of Search ..... 239/581.1, 581.2, 239/585.1, 585.2, 533.12, 533.4, 533.3, 533.2, 456

(56) References Cited

U.S. PATENT DOCUMENTS 4,993,643 * 2/1991 Schechter et al. ..... 239/533.12
5,201,299 * 4/1993 Kong ..... 123/527
5,284,020 * 2/1994 Brocard et al. ..... 137/118
5,645,225 * 7/1997 Hasegawa et al. ..... 239/581.1

FOREIGN PATENT DOCUMENTS 60-159882 10/1985 (JP) .
63-140172 9/1988 (JP) .
63-248966 10/1988 (JP) .
4-5469 1/1992 (JP) .
5-44598 2/1993 (JP) .
7-259705 10/1995 (JP) .
8-177677 7/1996 (JP) .

* cited by examiner

*Primary Examiner*—Patrick Brinson
*Assistant Examiner*—Davis Hwu
(74) *Attorney, Agent, or Firm*—Oliff & Berridge, PLC

(57) ABSTRACT

An injector comprises an injection nozzle 1 having a nozzle hole 3, a valve body 2 for controlling a fuel flow through the nozzle hole 3, and changing means 6, 7, 10, 11, 12, 13, 20 for changing a shape of fuel spray, the fuel spray being formed by the fuel which flows through the nozzle hole. The injector includes rotation preventing means for preventing the valve body 2 from rotating with respect to the injection nozzle 1 around a center axis of the valve body 2. The injector includes angular displacement controlling means for controlling an angular displacement of the valve body 2 with respect to the injection nozzle 1. A shape of a tip of the valve body 2 is circumferencially non-uniform.

20 Claims, 37 Drawing Sheets

INJECTOR

BACKGROUND OF THE INVENTION

1. Field of the Invention

The present invention relates to an injector.

2. Description of the Related Art

An injector which can change a fuel injecting direction, and an injector which can change a fuel spray divergent angle, are known in the prior art. Japanese Unexamined Patent Publication No. 4-5469 discloses an injector wherein a member with a nozzle hole can be moved with respect to an injection nozzle, or wherein a plurality of nozzle holes are provided and any one nozzle hole can be used, in order that the fuel injection direction can be changed.

However, in case of the injector disclosed in Japanese Unexamined Patent Publication No. 4-5469, since it is required that the member with the nozzle hole can be moved with respect to the injection nozzle, or that any one nozzle hole in the plurality of nozzle holes can be used, the structure of the nozzle hole becomes complex.

Further, Japanese Unexamined Patent Publication No. 5-44598 discloses an injector wherein an air flow is applied to an injected fuel in order to change a fuel injection direction.

However, in case of the injector disclosed in Japanese Unexamined Patent Publication No. 5-44598, since air flow applying means for apply an air flow to the injected fuel is required, the injector becomes larger.

Further, Japanese Unexamined Patent Publication No. 7-259705 discloses an injector wherein a position of the needle valve is changed with respect to an injection nozzle along a center axis of the needle valve, in order to change a fuel spray divergent angle.

However, in case of the injector disclosed in Japanese Unexamined Patent Publication No. 7-259705, since the position of the needle valve is changed with respect to the injection nozzle along the center axis of the needle valve, a fuel spray amount changes.

Further, Japanese Unexamined Utility Model Publication No. 63-140172 discloses an injector wherein a shape of a tip of a needle valve is asymmetrical with respect to a center axis of the needle valve, in order to make a difference between a fuel injecting direction and a center axis direction of an injection nozzle.

However, in case of the injector disclosed in Japanese Unexamined Utility Model Publication No. 63-140172, since the injector does not have rotating means for rotating the needle valve with respect to the injection nozzle around the center axis of the needle valve, the fuel injecting direction cannot be changed.

On the other hand, the above publications do not disclose means for controlling an angular displacement of the needle valve with respect to the injection nozzle and for changing the fuel injection direction or the fuel spray divergent angle, by preventing the needle valve with a circumferentially non-uniform tip from rotating with respect to the injection nozzle around the center axis of the needle valve, or by allowing the needle valve to rotate with respect to the injection nozzle around the center axis of the needle valve.

Also, the above publications do not disclose means for controlling an eccentricity of the center axis of the needle valve with respect to the center axis of the injection nozzle and for changing the fuel injection direction.

Further, an injector wherein a lift amount of a needle valve is changed during the valve opening period in order to change a target shape of a fuel spray is known in the prior art. The injector is, for example, disclosed in Japanese Unexamined Patent Publication No. 7-259705.

However, in case of the injector disclosed in Japanese Unexamined Patent Publication No. 7-259705, since the lift amount of the needle valve is changed during the valve opening period in order to change the target shape of the fuel spray, the target shape of the fuel spray cannot be changed while keeping a fuel injection rate constant.

Further, an injector wherein a needle valve for opening or closing a nozzle hole is provided, and the needle valve has an inner member with a tip and an outer member located outside of the inner member is known in the prior art. The injector is, for example, disclosed in Japanese Unexamined Patent Publication No. 8-177677, Japanese Unexamined Utility Model Publication No. 60-159882, and Japanese Unexamined Patent Publication No. 63-248966.

In case of the injector disclosed in FIG. 2 of the Japanese Unexamined Patent Publication No. 8-177677, Japanese Unexamined Utility Model Publication No. 60-159882, or Japanese Unexamined Patent Publication No. 63-248966, a relative position of the tip with respect to the outer member is changed. However, the relative position is not changed in accordance with a change of a target shape of a fuel spray, but is changed in accordance with a change of a fuel supply pressure with respect to the injector. That is, in case of the injector, the relative position of the tip with respect to the outer member cannot be changed in accordance with the change of the target shape of the fuel spray. Also, in case of the injector, the relative position of the tip with respect to the outer member cannot be changed while the fuel supply pressure with respect to the injector is kept constant.

Also, in case of the injector disclosed in FIG. 6 of the Japanese Unexamined Patent Publication No. 8-177677, the relative position of the tip with respect to the outer member is changed. However, the relative position is not changed in order to change the target shape of the fuel spray, but is changed in order to eject a fuel which remains in the nozzle hole during the valve closing period. That is, Japanese Unexamined Patent Publication No. 8-177677 does not disclose changing the relative position of the tip with respect to the outer member in order to change the target shape of the fuel spray.

Further, none of the above publications disclose changing the shape of the nozzle hole in accordance with the change of the lift amount of the needle valve in order to change the shape of the fuel spray.

Further, an injector which includes an injection nozzle having a nozzle hole and a valve body for opening or closing the nozzle hole, and which defines a fuel passage between an inner periphery of the injection nozzle and an outer periphery of the valve body is known in the prior art. The injector is, for example, disclosed in Japanese Unexamined Patent Publication No. 7-259705. In case of the injector disclosed in Japanese Unexamined Patent Publication No. 7-259705, a maximum lift position of the valve body is changed in order to change a shape of a fuel spray.

However, in case of the injector disclosed in Japanese Unexamined Patent Publication No. 7-259705, since the maximum lift position of the valve body is changed in order to change the shape of the fuel spray, if it is required to keep the maximum lift position of the valve body constant and, for example, if it is required to keep a fuel injection rate constant, the shape of the fuel spray cannot be changed.

On the other hand, if fuel spray shape changing means is provided outside of the injector, the shape of the fuel spray can be changed while keeping the maximum lift position of valve body constant. However, it is not preferable, since the fuel spray shape changing means is exposed to high temperature, if, for example, the injector is a direct injection type.

SUMMARY OF THE INVENTION

An object of the present invention is to provide an injector which can control an angular displacement of a valve body with respect to an injection nozzle around a center axis of a valve body and can change a fuel injection direction or a fuel spray divergent angle by preventing the valve body with a tip which is circumferencially non-uniform from rotating with respect to the injection nozzle around the center axis of the valve body, or by allowing the valve body to rotate with respect to the injection nozzle around the center axis of the valve body.

Another object of the present invention is to provide an injector which can change a fuel injection direction by controlling an eccentricity of a center axis of a valve body with respect to a center axis of an injection nozzle.

Another object of the present invention is to provide an injector which can change a relative position of a tip of an inner member of a valve body with respect to an outer member in order to change a target shape of a fuel spray.

Another object of the present invention is to provide an injector which can change a shape of a nozzle hole on the basis of a lift amount of a valve body in order to change a shape of a fuel spray.

Another object of the present invention is to provide an injector which can change a shape of a fuel spray by fuel spray shape changing means located inside of the injector, even if a maximum lift position of a valve body is kept constant.

The present invention provides an injector; comprising:

an injection nozzle having a nozzle hole;

a valve body for controlling a fuel flow through the nozzle hole; and changing means for changing a shape of a fuel spray, the fuel spray being formed by the fuel which flows through the nozzle hole.

Preferably, the injector further includes rotation preventing means for preventing the valve body from rotating with respect to the injection nozzle around a center axis of the valve body.

Preferably, the rotation preventing means prevents the valve body from rotating with respect to the injection nozzle when the rotation of the valve body with respect to the injection nozzle should be prevented, and the valve body is allowed to rotate with respect to the injection nozzle around the center axis of the valve body when the rotation preventing means does not prevent the valve body from rotating with respect to the injection nozzle.

Preferably, the injector further includes angular displacement controlling means for controlling an angular displacement of the valve body with respect to the injection nozzle.

Preferably, a shape of a tip of the valve body is circumferencially non-uniform.

Therefore, the injector can change the fuel injection direction or can change the fuel spray divergent angle.

Preferably, the tip of the valve body has two surfaces which are parallel to the center axis of the valve body and are parallel each other, and the nozzle hole is a slit. Therefore, the injector can change the fuel spray divergent angle.

Preferably, the tip of the valve body is non-uniformly formed with respect to the center axis of the valve body. Therefore, the injector can change the fuel injection direction.

Preferably, the center axis of the valve body is allowed to be eccentrically located with respect to a center axis of the injection nozzle, and the injector further comprises eccentricity controlling means for controlling an eccentricity of the center axis of the valve body with respect to the center axis of the injection nozzle. Therefore, the injector can change the fuel injection direction.

Preferably, the injector further includes a first position in which the center axis of the valve body is eccentrically located with respect to the center axis of the injection nozzle, a second position in which the center axis of the valve body is concentrically located with respect to the center axis of the injection nozzle, and a third position in which the center axis of the valve body is located on the opposite side of the center axis of the injection nozzle from the first position. Therefore, the injector can change the fuel injection direction in three steps.

Preferably, the valve body includes an inner member with a tip and an outer member located outside of the inner member, and a relative position of the tip with respect to the outer member during the valve opening period is decided on the basis of a target fuel spray to be injected, and then the tip is positioned to the decided position. That is, the relative position of the tip with respect to the outer member is changed without reference to a fuel supply pressure with respect to the injector, but on the basis of the target shape of the fuel spray. Therefore, even if the fuel supply pressure with respect to the injector does not change, the relative position of the tip of the inner member with respect to the outer member can be changed in order to change the target shape of the fuel spray. In this case, a minimum cross section of a fuel passage during the valve opening period is not defined by the inner member of the valve body, but is defined by the injection nozzle and the outer member of the valve body. Accordingly, the target shape of the fuel spray can be changed by changing the relative position of the tip of the inner member of the valve body with respect to the outer member, while keeping the injection rate constant.

Preferably, the valve body includes an inner member with a tip and an outer member located outside of the inner member, and the changing means includes selecting means for selecting a protruding amount of the tip with respect to the outer member during the valve opening period. That is, the protruding amount of the tip with respect to the outer member is changed by the selecting means, without reference to the fuel supply pressure with respect to the injector. Therefore, even if the fuel supply pressure with respect to the injector does not change, the protruding amount of the tip with respect to the outer member can be changed. In this case, the minimum cross section of the fuel passage during the valve opening period is not defined by the inner member of the valve body, but is defined by the injection nozzle and the outer member of the valve body. Accordingly, the protruding amount of the tip of the inner member of the valve body with respect to the outer member can be changed, while keeping the injection rate constant.

Preferably, the outer member is hollow over its full length, and the selecting means is located on the opposite side of the inner member from the tip and outside of the outer member. Therefore, the injector can prevent the fuel to be injected impinging on the selecting means and a fuel spray being disturbed. Further, the outer member of the valve body can be small.

Preferably, the changing means changes the shape of fuel spray by changing a shape of the nozzle hole on the basis of a lift amount of the valve body.

Preferably, the valve body is hollow in order that a fuel to be injected can flow inside of the hollow valve body, and the valve body has a through opening of the valve body in order that the fuel which flows inside of the hollow valve body can flow out of the hollow valve body, and the injection nozzle has a through opening of the injection nozzle in order that the fuel which flows through the through opening of the valve body can flow out of the injector, and the nozzle hole is defined by an overlapping area of the through opening of the valve body and the through opening of the injection nozzle. Therefore, the injector can change the target shape of the fuel spray by a method which is different from the prior art method.

Preferably, the nozzle hole is a slit, and the valve body is hollow, and the valve body has a first opening placed downstream with respect to a fuel seal portion in order that the fuel to be injected can flow into the valve body, and a second opening placed downstream with respect to the first opening in order that the fuel which flows into the valve body can flow out of the valve body, and an upstream width of the second opening is smaller than a downstream width of the second opening and smaller than a width of the slit, and as a lift amount of the valve body increases, an overlapping area of the slit and the second opening increases, and after a valve opening motion is completed, a minimum cross section of a fuel passage is defined by the first opening and is kept constant. Therefore, the injector can change the shape of the fuel spray by changing the lift amount of the valve body and changing the overlapping area of the slit and the second opening. Further, the minimum cross section of a fuel passage during the valve opening period, i.e., after the valve body is opened is defined by the first opening of the valve body without reference to the overlapping area of the slit and the second opening. Therefore, the shape of the fuel spray can be changed by changing the lift amount of the valve body and by changing the overlapping area of the slit and the second opening, while keeping the fuel injection constant.

Preferably, the width of the second opening becomes gradually smaller as a position in which the width of the second opening is measured shifts from downstream to upstream. Therefore, as the lift amount of the valve body increases, a width of the overlapping area of the slit and the second opening increases. Accordingly, the injector can gradually increase the fuel spray divergent angle by gradually increasing the lift amount of the valve body.

Preferably, an intersection point of an extension line from a surface of a left side wall of the second opening and an extension line from a surface of a right side wall of the second opening is located on the opposite side of a center line of the valve body from the second opening, in the cross sectional view of the second opening. Therefore, the fuel flowing inside of the valve body can more easily flow into the second opening than if the intersection point is located near the second opening. Accordingly, the injector can form the fuel spray whose turbulence is smaller than if the intersection point is located near the second opening.

Preferably, a fuel passage is defined by an inner periphery of the injection nozzle and an outer periphery of the valve body, and a fuel flow controlling member is located in the fuel passage, and the fuel flow controlling member is moved along a center axis of the injector in order that the fuel flow can be changed in the fuel passage. Therefore, the injector can change the shape of the fuel spray. That is, even if the lift amount of the valve body is not changed, the injector can change the fuel flow in the fuel passage and the nozzle hole and change the shape of the fuel spray by moving the fuel flow controlling member along the center axis of the injector.

Preferably, the fuel flow controlling member is moved such that a cross sectional area of the fuel passage is decreased to a cross sectional area of the nozzle hole in order to decrease a rate of fuel injection. Therefore, the injector can decrease the injection rate. Further, even if, for example, the injector cannot decrease a fuel injection period, the injector can decrease the injection rate.

Preferably, fuel supply pressure with respect to the injector is changed in order to move the fuel flow controlling member along the center axis of the injector. Therefore, the injector can move the fuel flow controlling member along the center axis of the injector by fuel supply means for supplying the fuel to the injector without providing another moving means for moving the fuel flow controlling member, and can change the shape of the fuel spray.

Preferably, a tip of the fuel flow controlling member is comprised of a seal portion and a notch portion, and a shape of the tip of the fuel flow controlling member is asymmetric. Therefore, the injector can form a difficultly flowing portion of the fuel and an easily flowing portion of the fuel in the fuel passage defined by the inner periphery of the injection nozzle and the outer periphery of the valve body. Accordingly, the injector can change the locations of the difficultly flowing portion and the easily flowing portion by changing the position of the fuel flow controlling member. The injector can effectively change the fuel flow in the fuel passage and the nozzle hole and change the shape of the fuel spray.

Preferably, a fuel passage is defined by an inner periphery of the injection nozzle and an outer periphery of the valve body, and a cylindrical member is located on a tip side of the valve body in the fuel passage, and the cylindrical member is movable independently of the valve body, and at least one communicating portion for communicating with an outer periphery and an inner periphery of the cylindrical member is located at a tip portion of the cylindrical member, and the cylindrical member is moved in the same direction as a moving direction of the valve body in order to change the fuel flow in the fuel passage. Therefore, the injector can change the shape of the fuel spray by making the fuel flow toward the nozzle hole circumferentially non-uniform when a lift amount of the cylindrical member is made small, and by making the fuel flow toward the nozzle hole circumferentially relatively uniform when a lift amount of the cylindrical member is made large.

BRIEF DESCRIPTION OF THE DRAWINGS

The above and other objects, features and advantages of the present invention will be made more apparent from the following description of the preferred embodiments thereof in conjunction with the accompanying drawings wherein.

DESCRIPTION OF THE PREFERRED EMBODIMENTS

Figure 1:
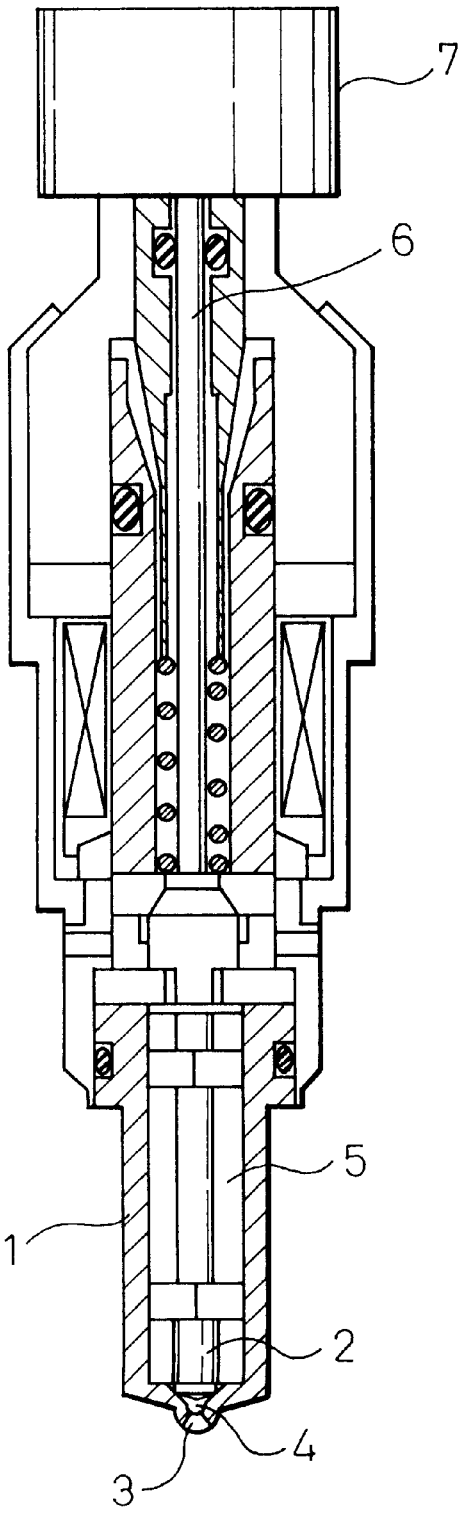
FIG. 1 is a schematic sectional view of a first embodiment of the injector of the present invention.

FIG. 1 shows a schematic sectional view of a first embodiment of an injector of the present invention. In FIG. 1, numeral 1 designates an injection nozzle, numeral 2 designates a valve body, numeral 3 designates a nozzle hole, numeral 4 designates a fuel pooling portion, and numeral 5 designates a fuel passage. Numeral 6 designates a rotation shaft for rotating the valve body 2 with respect to the injection nozzle 1 around a center axis of the valve body 2. Numeral 7 shows a stepping motor for driving the rotation shaft 6.

Figure 2A:
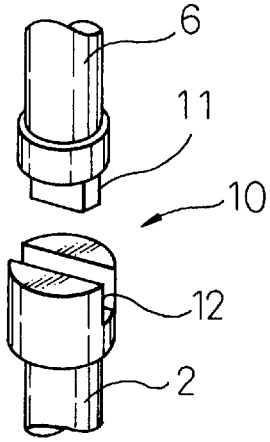
FIGS. 2A to 2C respectively show a coupling portion of a rotation shaft and a valve body.
Figure 2B:
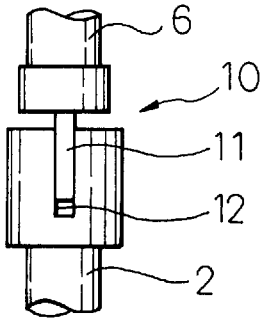
Figure 2C:
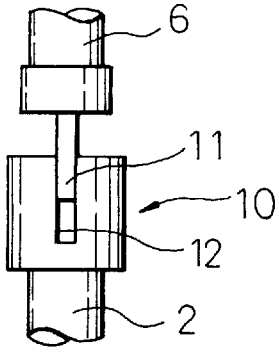
Figure 3:
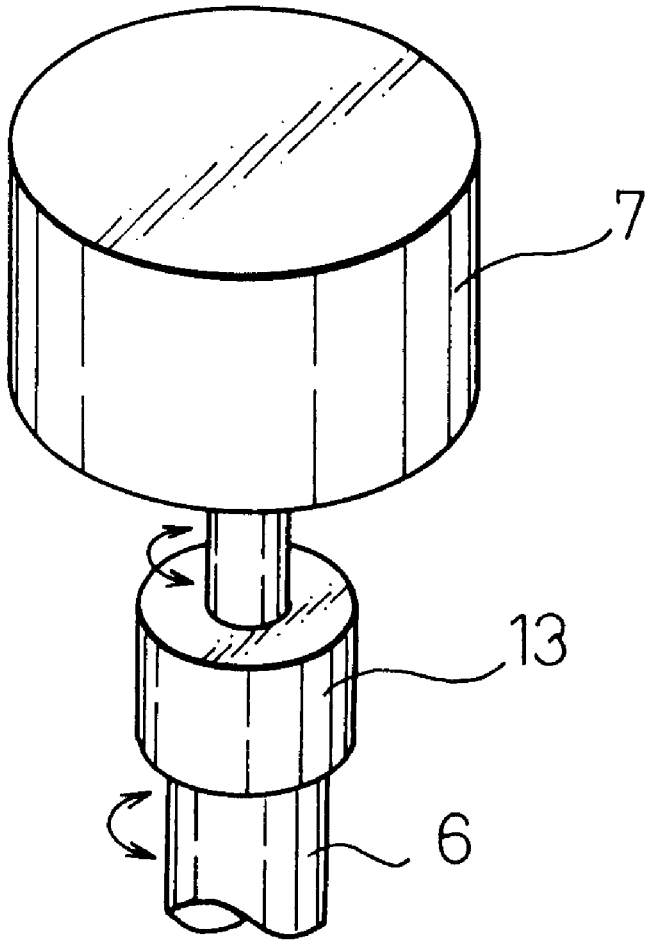
FIG. 3 shows a coupling portion of the rotation shaft and a stepping motor.

FIGS. 2A to 2C respectively show a coupling portion of the rotation shaft and the valve body. Particularly, FIG. 2A is a perspective view of the coupling portion of the rotation shaft and the valve body. FIG. 2B is a side view of the coupling portion during the valve fully opening period. FIG. 2C is a side view of the coupling portion during the valve fully closing period. FIG. 3 shows a coupling portion of the rotation shaft and the stepping motor. In FIGS. 2 and 3, numeral 10 designates the coupling portion of the rotation shaft 6 and the valve body 2. Numeral 11 designates a coupling protrusion. Numeral 12 designates a coupling groove for engaging with the coupling protrusion 11. Numeral 13 designates the coupling for coupling the stepping motor 7 and the rotation shaft 6.

As shown in FIG. 2, when a drive pulse is not supplied to the stepping motor 7, the valve body 2 is prevented from rotating with respect to the injection nozzle 1 around the center axis of the valve body 2 by engaging the coupling protrusion 11 with the coupling groove 12. On the other hand, when drive pluses are supplied to the stepping motor 7, the valve body 2 is allowed to rotate with respect to the injection nozzle 1 around the center axis of the valve body 2. Also, an angular displacement of the valve body 2 with respect to the injection nozzle 1 can be controlled by controlling the number of the drive pluses supplied to the stepping motor 7.

Particularly, as shown in FIGS. 2*b* and 2C, the coupling protrusion 11 engages with the coupling groove 12 not only during the valve fully opening period (FIG. 2B), but also during the valve fully closing period (FIG. 2C). That is, an angular motion of the valve body 2 is always restricted by the stepping motor 7.

Figure 4A:
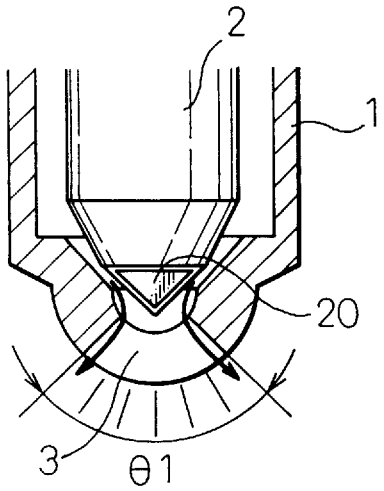
FIGS. 4A to 4C respectively show a tip of a valve body and a tip of an injection nozzle.
Figure 4B:
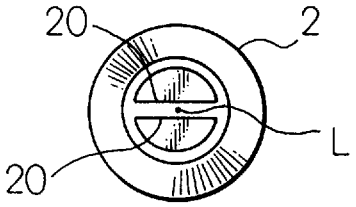
Figure 4C:
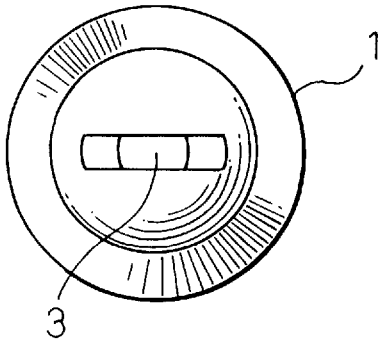

FIGS. 4A to 4C respectively show a tip of the valve body and a tip of the injection nozzle. Particularly, FIG. 4A is a partially sectional side view of the tip of the valve body 2 and the tip of the injection nozzle 1. FIG. 4B is an end view of the valve body 2. FIG. 4C is an end view of the injection nozzle 1. As shown in FIGS. 4A to 4C, the tip of the valve body 2 is circumferentially non-uniform. That is, the tip of the valve body 2 has two surfaces 20 which are parallel to the center axis L of the valve body 2 and are parallel each other. The two surfaces 20 are symmetrical with respect to the center axis L. The two surfaces 20 can be formed by additionally working the tip of the valve body 2. Further, the nozzle hole 3 is a slit. The fuel spray divergent angle θ1 becomes relatively large when the valve body 2 is positioned with respect to the injection nozzle 1 such that the surfaces 20 are parallel to a longitudinal direction of the nozzle hole 3 as shown in FIG. 4A.

Figure 5A:
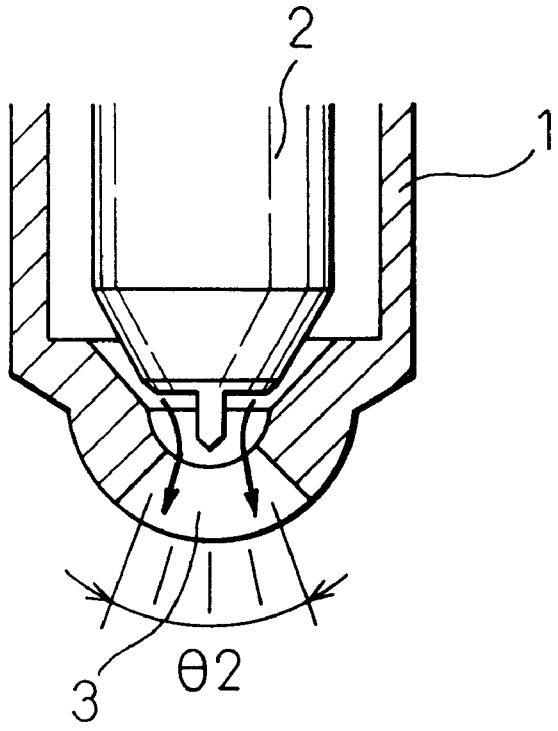
FIGS. 5A and 5B respectively show the tip of the valve body and the tip of the injection nozzle, the valve body being rotated 90 degrees from the position shown in FIGS. 4A to 4C around its center axis.
Figure 5B:
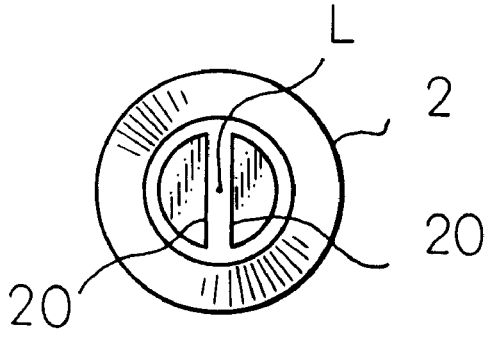

FIGS. 5A and 5B respectively show the tip of the valve body and the tip of the injection nozzle, the valve body being rotated 90 degrees from the position shown in FIGS. 4A to 4C around its center axis. As shown in FIGS. 5A and 5B, as a result of 90 degrees rotation of the valve body 2 around the center axis L from the position shown in FIGS. 4A to 4C, the surfaces 20 are placed substantially vertical to the longitudinal direction of the nozzle hole 3. Therefore, a fuel flow through the nozzle hole 3 is changed, a fuel spray divergent angle θ2 becomes smaller than the fuel spray divergent angle θ1 (FIG. 4A).

Although FIGS. 5A and 5B only show the valve body 2 which is rotated 90 degrees from the position shown in FIGS. 4A to 4C around its center axis L, the fuel spray divergent angle can be continuously controlled by continuously controlling a rotation amount of the valve body 2 with respect to the injection nozzle 1 from 0 degree to 90 degrees.

According to the present embodiment, the angular displacement of the valve body 2 whose tip is circumferentially non-uniform with respect to the injection nozzle 1 is controlled by preventing the valve body 2 from rotating with respect to the injection nozzle 1 around the center axis L, or by allowing the valve body 2 to rotate with respect to the injection nozzle 1 around the center axis L. Particularly, the tip of the valve body 2 has the two surfaces 20 which are parallel to the center axis L and are parallel each other, and the nozzle hole 3 is the slit. Therefore, the fuel spray divergent angle θ can be changed.

Particularly, in case of a direct injection type engine, during a stratified combustion, the fuel spray divergent angle θ is made small as shown in FIG. 5A, and the fuel spray is concentrated around a sparking plug. On the other hand, during a homogeneous combustion, the fuel spray divergent angle θ is made large as shown in FIG. 4A, and the fuel spray is dispersed in a combustion chamber. Accordingly, an engine performance can be increased.

Further, if the fuel spray divergent angle θ is changed by providing the surfaces 20 and the slit nozzle hole 3 in the present embodiment, the fuel spray divergent angle θ can be more easily changed from a small value to a large value, than if the fuel spray divergent angle is changed by changing a position of the valve body with respect to the injection nozzle along the center axis of the valve body as disclosed in Japanese Unexamined Patent Publication No. 7-259705. Also, the fuel injection direction is not restricted to a direction of the center axis L of the valve body in the present embodiment.

Figure 6A:
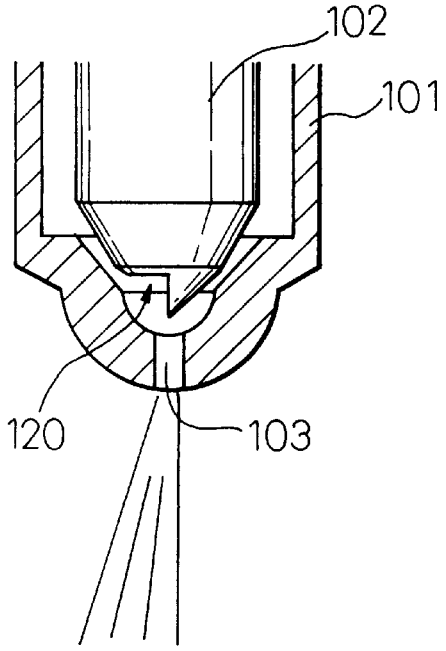
FIGS. 6A to 6C respectively show a tip of a valve body and a tip of an injection nozzle of a second embodiment of the injector of the present invention.
Figure 6B:
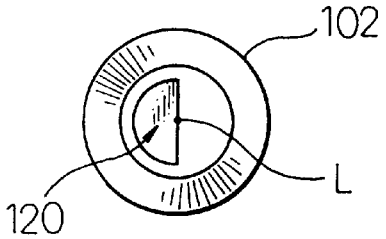
Figure 6C:
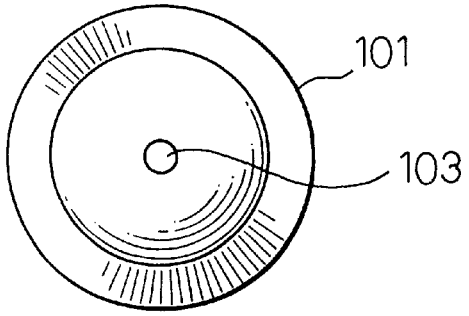

FIGS. 6A to 6C respectively show a tip of a valve body and a tip of an injection nozzle of a second embodiment of the injector of the present invention. A cross section of the present embodiment is substantially the same as the cross sectional of FIG. 1 of the first embodiment. A coupling portion of a rotation shaft and a valve body of the present embodiment and a coupling portion of a stepping motor and the rotating shaft are respectively substantially the same as the coupling portion in FIGS. 2A to 2C and the coupling portion in FIG. 3 of the first embodiment.

Particularly, FIG. 6A is a partially sectional side view of a tip of the valve body and a tip of the injection nozzle. FIG. 6B is an end view of the valve body. FIG. 6C is an end view of the injection nozzle. In FIGS. 6A to 6C, numeral 101 designates an injection nozzle. Numeral 102 designates a valve body. Numeral 103 designates a nozzle hole. Numeral 120 designates a notch. As shown in FIGS. 6A to 6C, the tip of the valve body 102 is circumferentially non-uniformly formed. That is, the tip of the valve body 102 has the notch 120, and the tip of the valve body 102 is non-uniformly formed with respect to a center axis L of the valve body 102. When the valve body 102 is positioned with respect to the injection nozzle 101 as shown in FIGS. 6A to 6C, a fuel injection direction does not correspond to a direction of the center axis L of the valve body 102, but is directed toward a side of the notch 120 (toward a left side of FIG. 6A).

Figure 7A:
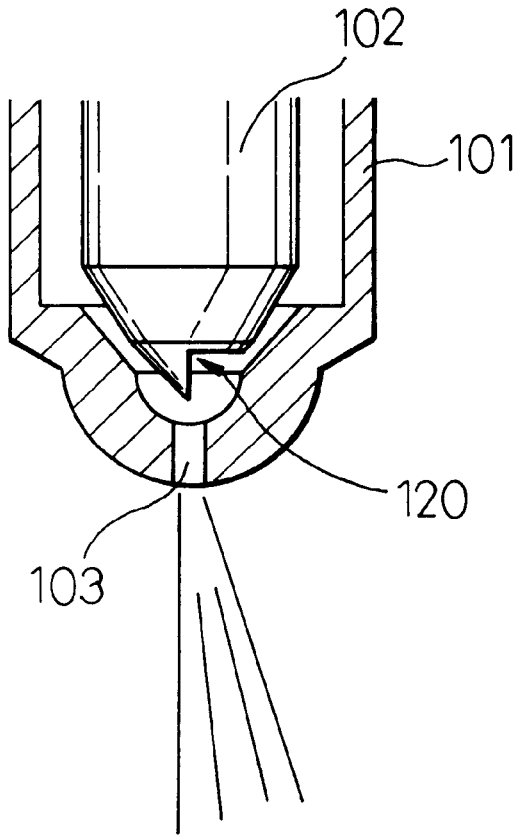
FIGS. 7A and 7B respectively show the tip of the valve body and the tip of the injection nozzle, the valve body being rotated 180 degrees from the position shown in FIGS. 6A to 6C around its center axis.
Figure 7B:
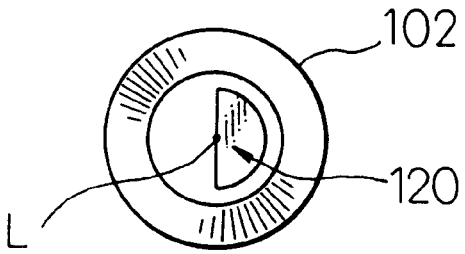

FIGS. 7A and 7B respectively show the tip of the valve body and the tip of the injection nozzle, when the valve body is rotated 180 degrees from the position shown in FIGS. 6A to 6C around its center axis. As shown in FIGS. 7A and 7B, as a result of the 180 degrees rotation of the valve body 102 from a position shown in FIGS. 6A to 6C around the center axis L, the notch 120 is located on the opposite side of the center axis L from a position of the notch 120 shown in FIGS. 6A to 6C. Therefore, the fuel injection direction is changed from the direction shown in FIG. 6A and is directed toward a side of the notch 120 (toward a right side of FIG. 7A).

Although FIGS. 7A and 7B only show the valve body 102 which is rotated 180 degrees from the position shown in FIGS. 6A to 6C around its center axis L, the fuel spray divergent angle can be continuously changed by continuously controlling a rotation amount of the valve body 102 with respect to the injection nozzle 101 from 0 degree to 180 degrees.

According to the present embodiment, the angular displacement of the valve body 102 whose tip is circumferentially non-uniform with respect to the injection nozzle 101 is controlled by preventing the valve body 102 from rotating with respect to the injection nozzle 101 around the center axis L, or by allowing the valve body 102 to rotate with respect to the injection nozzle 101 around the center axis L. Particularly, the tip of the valve body 102 has the notch 120, and the tip of the valve body 102 is non-uniformly formed with respect to the center axis L. Therefore, the fuel injection direction can be changed by rotating the valve body 102 with respect to the injection nozzle 101 around the center axis L.

That is, if a fuel injection direction cannot be changed, an impinging position of a fuel spray and a piston changes when a fuel injection timing is changed in accordance with an engine operation condition. Therefore, a motion of the fuel spray changes after impinging against the piston. On the other hand, if the fuel injection direction can be changed in the present embodiment, an impinging position of the fuel spray and a piston can always be kept at one position by changing the fuel injection direction in accordance with a change of a fuel injection timing. Therefore, a change of a motion of the fuel spray after impinging against the piston can be prevented.

Particularly, in case of a direct injection type engine, during a stratified combustion, the fuel spray can be certainly concentrated near a sparking plug. Accordingly, an engine performance can be increased.

Figure 8A:
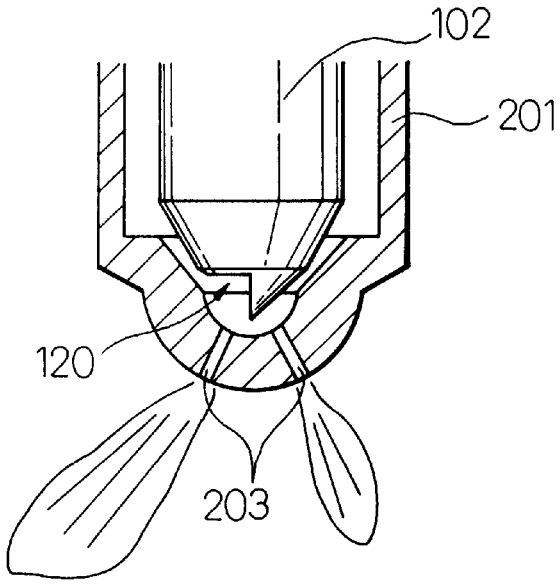
FIGS. 8A to 8C respectively show a tip of a valve body and a tip of an injection nozzle of a third embodiment of the injector of the present invention.
Figure 8B:
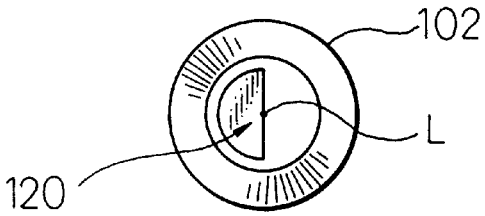
Figure 8C:
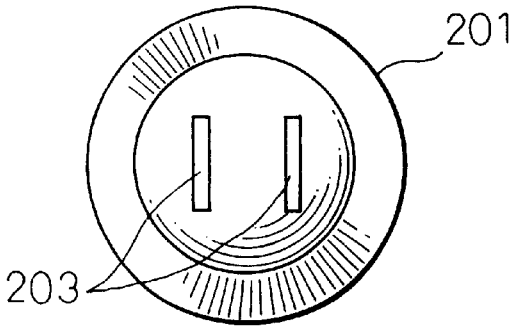

FIGS. 8A to 8C respectively show a tip of a valve body and a tip of an injection nozzle of a third embodiment of the injector of the present invention. A cross section of the present embodiment is substantially the same as the cross sectional of FIG. 1 of the first embodiment. A coupling portion of a rotation shaft and a valve body of the present embodiment and a coupling portion of a stepping motor and the rotating shaft are respectively substantially the same as the coupling portion in FIGS. 2A to 2C and the coupling portion in FIG. 3 of the first embodiment.

Particularly, FIG. 8A is a partially sectional side view of a tip of the valve body and a tip of the injection nozzle. FIG. 8B is an end view of the valve body. FIG. 8C is an end view of the injection nozzle. In FIGS. 8A to 8C, the valve body 102 and a notch 120 are respectively the same as the valve body 102 and the notch 120 shown in FIGS. 6A to 6C of the second embodiment. Numeral 201 designates an injection nozzle. Numeral 203 designates nozzle holes. As shown in FIGS. 8A to 8C, the tip of the injection nozzle 201 has two slit nozzle holes 203. In another embodiment, the number of nozzle holes may be more than two, and the shape of the nozzle hole may not be slit, but may be circular. In the present embodiment, when the valve body 102 is positioned with respect to the injection nozzle 201 as shown in FIGS. 8A to 8C, a fuel spray becomes large on a side of the notch 120 (on a left side of FIG. 8A), and a fuel spray becomes small on the opposite side (on a right side of FIG. 8A).

Figure 9A:
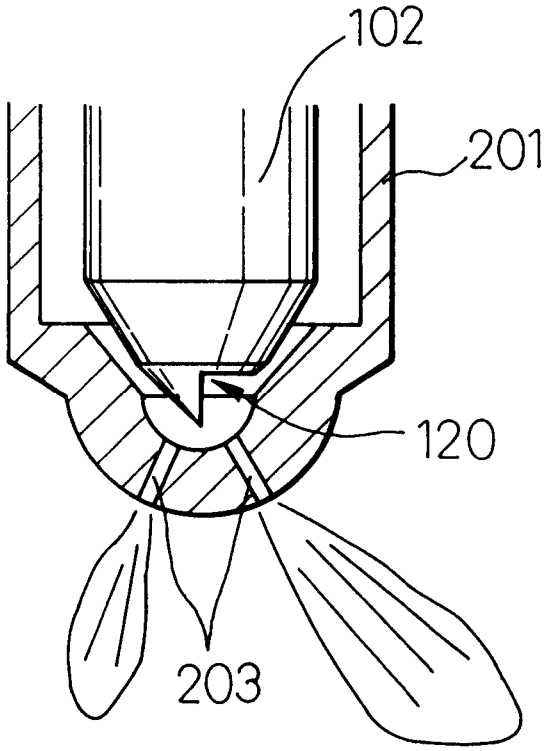
FIGS. 9A and 9B respectively show the tip of the valve body and the tip of the injection nozzle, the valve body being rotated 180 degrees from the position shown in FIGS. 8A to 8C around its center axis.
Figure 9B:
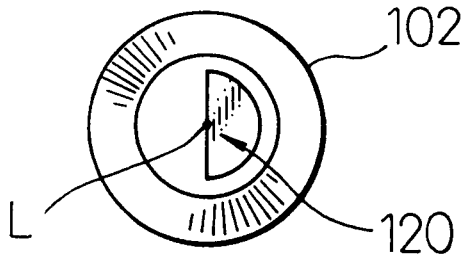

FIGS. 9A and 9B respectively show the tip of the valve body and the tip of the injection nozzle, when the valve body is rotated 180 degrees from the position shown in FIGS. 8A to 8C around its center axis. As shown in FIGS. 9A and 9B, as a result of the 180 degrees rotation of the valve body 102 from a position shown in FIGS. 8A to 8C around the center axis L, the notch 120 is located on the opposite side of the center axis L from a position of the notch 120 shown in FIGS. 8A to 8C. Therefore, the shape of the fuel spray is changed from the shape of the fuel spray shown in FIG. 8A. The fuel spray becomes large on a side of the notch 120 (on a right side of FIG. 9A), and the fuel spray becomes small on the opposite side (on a left side of FIG. 9A).

Although FIGS. 9A and 9B only show the valve body 102 which is rotated 180 degrees from the position shown in FIGS. 8A to 8C around its center axis L, the shape of the fuel spray can be continuously changed by continuously controlling a rotation amount of the valve body 102 with respect to the injection nozzle 201 from 0 degree to 180 degrees.

According to the present embodiment, the angular displacement of the valve body 102 whose tip is circumferentially non-uniform with respect to the injection nozzle 201 is controlled by preventing the valve body 102 from rotating with respect to the injection nozzle 201 around the center axis L, or by allowing the valve body 102 to rotate with respect to the injection nozzle 201 around the center axis L. Particularly, the tip of the valve body 102 has the notch 120, and the tip of the valve body 102 is non-uniformly formed with respect to the center axis L. Further, the tip of the injection nozzle 201 has a plurality of nozzle holes 203. Therefore, the shape of the fuel spray can be changed by rotating the valve body 102 with respect to the injection nozzle 201 around the center axis L.

That is, if a shape of a fuel spray cannot be changed, an impinging position of a fuel spray on a piston changes when a fuel injection timing is changed in accordance with an engine operation condition. Therefore, a motion of the fuel spray changes after impinging against the piston. On the other hand, if the shape of the fuel spray can be changed, as in the present embodiment, an impinging position of the fuel spray and a piston can always be kept at one position by changing the fuel injection direction in accordance with a change of a fuel injection timing. Therefore, a change of a motion of the fuel spray after impinging against the piston can be prevented.

Figure 10A:
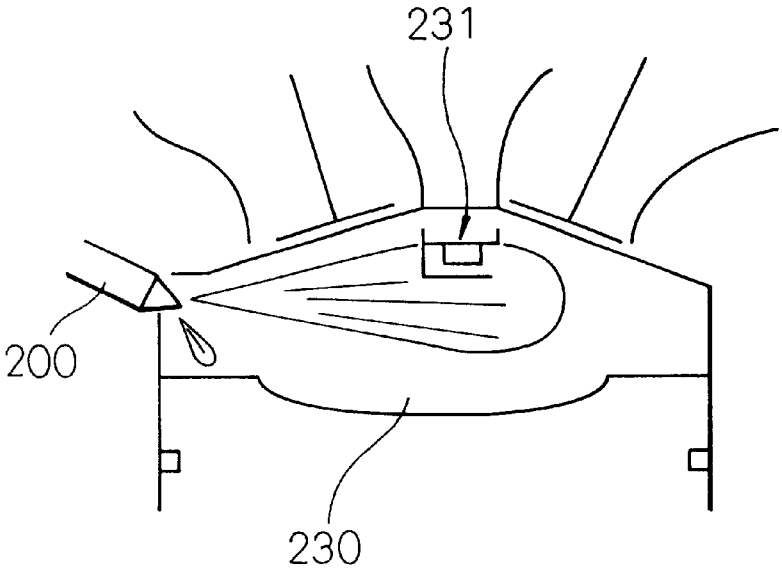
FIGS. 10A and 10B respectively show schematic side views of a portion of an engine in which the injector of the third embodiment is applied to a direct injection type engine.
Figure 10B:
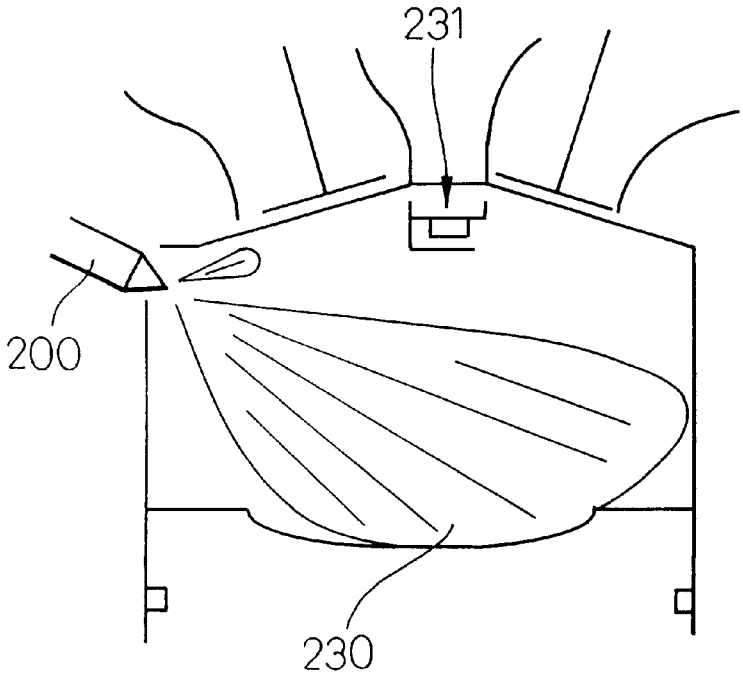

FIGS. 10A and 10B respectively show schematic side views of a portion of an engine in which the injector of the third embodiment is applied to a direct injection type engine. Particularly, FIG. 10A shows the engine during a stratified combustion. FIG. 10B shows the engine during a homogeneous combustion. In FIGS. 10A and 10B, numeral 200 designates an injector, numeral 230 designates a combustion chamber, and numeral 231 designates a spark plug. As shown in FIGS. 10A and 10B, during the stratified combustion, a fuel spray on a side of the spark plug 231 (on an upper side of FIG. 10A) becomes large, and a fuel spray on a center side of the combustion chamber 230 (on a lower side of 10A) becomes small. That is, the fuel spray can be certainly concentrated near the spark plug 231. Accordingly, an engine performance can be increased. On the other hand, during the homogeneous combustion, a fuel spray on the side of the spark plug 231 (on an upper side of FIG. 10B) becomes small, and a fuel spray on the center side of the combustion chamber 230 (on a lower side of 10B) becomes large. Accordingly, the fuel spray is homogeneously dispersed all over the combustion chamber 230.

Figure 11:
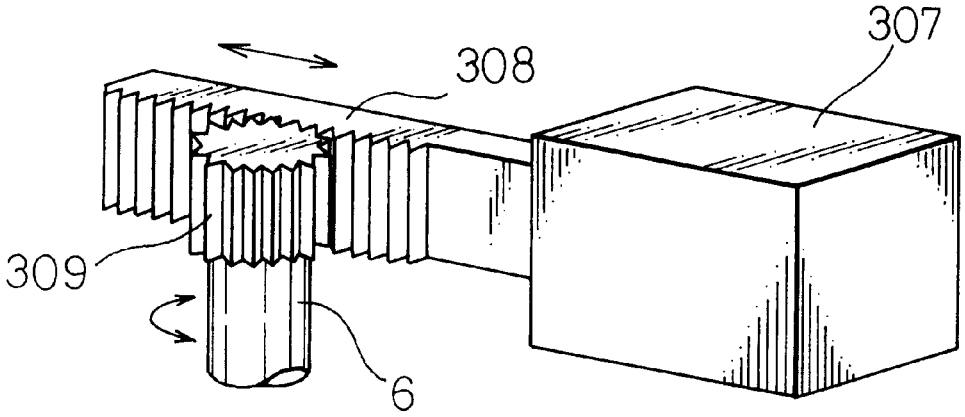
FIG. 11 shows a driving force transmission device between a solenoid and a rotation shaft of a fourth embodiment of the injector of the present invention.

FIG. 11 shows a driving force transmission device between a solenoid and a rotation shaft of a fourth embodiment of the injector of the present invention. In the present embodiment, the stepping motor and the coupling (FIG. 3) of the first to third embodiments are modified to a solenoid and a rack-and-pinion driving mechanism. In FIG. 11, numeral 307 designates a solenoid, numeral 308 designates a rack connected to an actuator (not shown) of the solenoid 307, and numeral 309 designates a pinion gear for engaging with the rack 308. While a switch of the solenoid 307 is kept "on" or "off", a rotation of the center shaft 6 is prevented. On the other hand, when the solenoid 307 is switched on, or when the solenoid 307 is switched off, the center shaft 6 is rotated.

According to the present embodiment, the angular displacement of the valve body whose tip is circumferentially non-uniform with respect to the injection nozzle is controlled by preventing the valve body from rotating with respect to the injection nozzle around the center axis L, or by allowing the valve body to rotate with respect to the injection nozzle around the center axis L. Therefore, the fuel spray divergent angle, the injection direction, or the shape of the fuel spray can be changed.

Figure 12A:
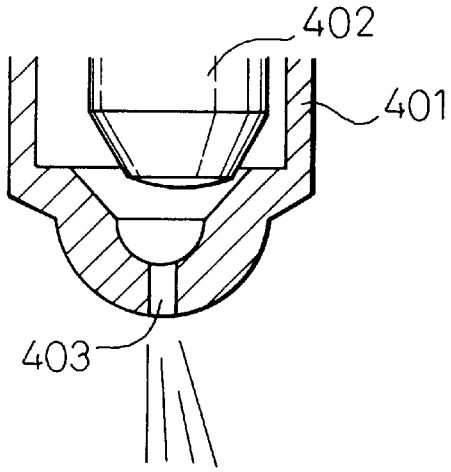
FIGS. 12A to 12C respectively show a tip of a valve body and a tip of an injection nozzle of a fifth embodiment of the injector of the present invention.
Figure 12B:
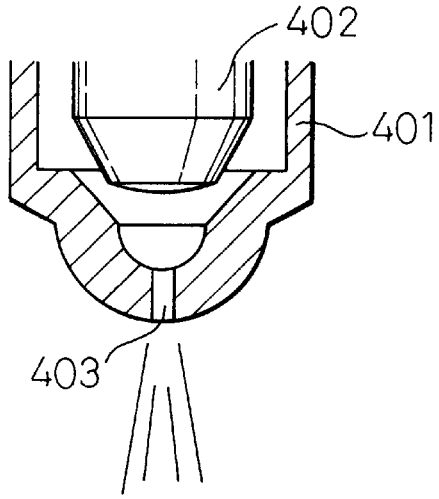
Figure 12C:
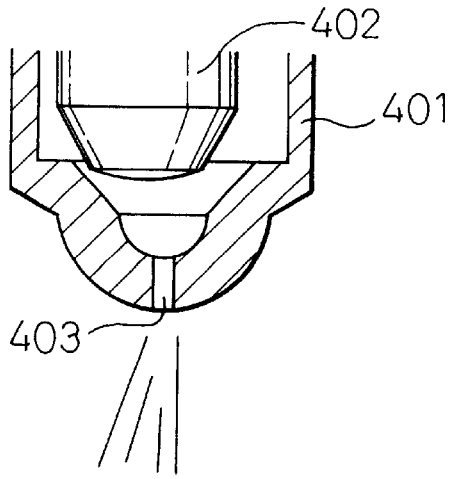
Figure 13:
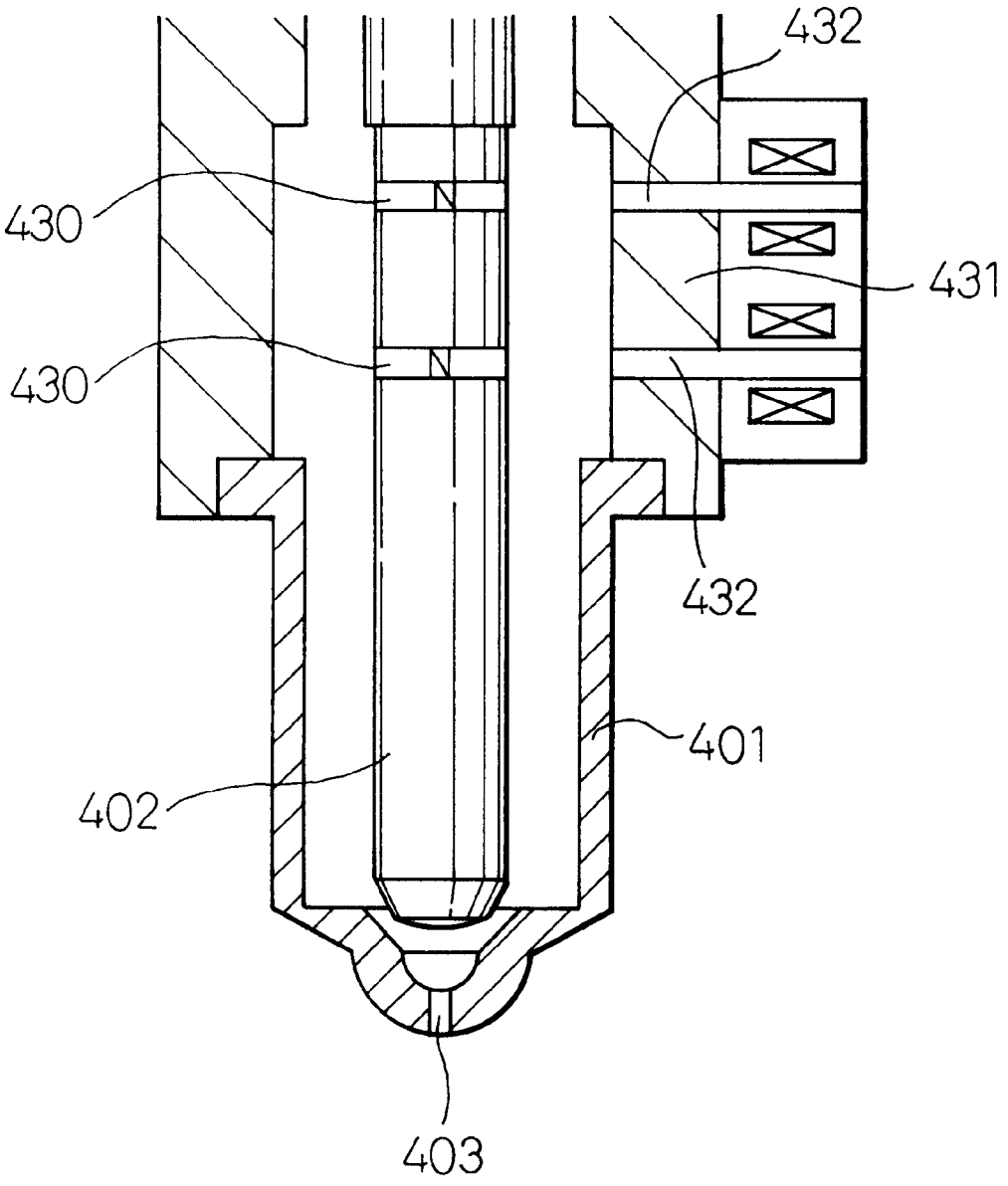
FIG. 13 shows changing means for changing an eccentricity of a center axis of the valve body with respect to a center axis of the injection nozzle.

FIGS. 12A to 12C respectively show a tip of a valve body and a tip of an injection nozzle of a fifth embodiment of the injector of the present invention. FIG. 13 shows changing means for changing an eccentricity of a center axis of the valve body with respect to a center axis of the injection nozzle. In FIGS. 12 and 13, numeral 401 designates an injection nozzle, numeral 402 designates a valve body, numeral 403 designates a nozzle hole formed at a tip of the injection nozzle, numeral 430 designates a magnetized portion as a north pole (N). Numeral 431 designates an injector housing and numeral 432 designates an electromagnet placed in the injector housing 431 for applying an attracting force or a repulsive force to the magnetized portion 430.

When the electromagnet 432 applies an attracting force to the magnetized portion 430, the valve body 402 is eccentrically located with respect to a center axis of the injection nozzle 401 toward the electromagnet 432 (toward a right side of FIG. 12A) as shown in FIG. 12A. As a result, a fuel injection direction is directed to a side of the electromagnetic 432 (to a right side of the FIG. 12A).

When the electromagnet 432 does not apply an attracting force or repulsive force to the magnetized portion 430, the valve body 402 is concentrically located with respect to the center axis of the injection nozzle 401 as shown in FIG. 12B. As a result, a fuel injection direction corresponds to a direction of the center axis of the injection nozzle 401. That is, the fuel injection direction corresponds to a direction of a center axis of the nozzle hole 403.

When the electromagnet 432 applies a repulsive force to the magnetized portion 430, the valve body 402 is eccentrically located with respect to the center axis of the injection nozzle 401 toward the opposite side of the electromagnet 432 (toward a left side of FIG. 12C) as shown in FIG. 12C. As a result, a fuel injection direction is directed to the opposite side of the electromagnetic 432 (to a left side of the FIG. 12C).

In another embodiment, the magnetized portion may be magnetized as a south pole (S).

According to the present embodiment, the injector can change the fuel injection direction by controlling the eccentricity of the center axis of the valve body 402 with respect to the center axis of the injection nozzle 401.

Further, according to the present embodiment, the injector includes a first position in which the center axis of the valve body 402 is eccentrically located with respect to the center axis of the injection nozzle 401 toward a side of the electromagnetic 432 (FIG. 12A), a second position in which the center axis of the valve body 402 is concentrically located with respect to the center axis of the injection nozzle 401 (FIG. 12B), and a third position in which the center axis of the valve body 402 is located on the opposite side of the center axis of the injection nozzle 401 from the first position (FIG. 12C). Therefore, the injector can change the fuel injection direction in three steps.

Figure 14:
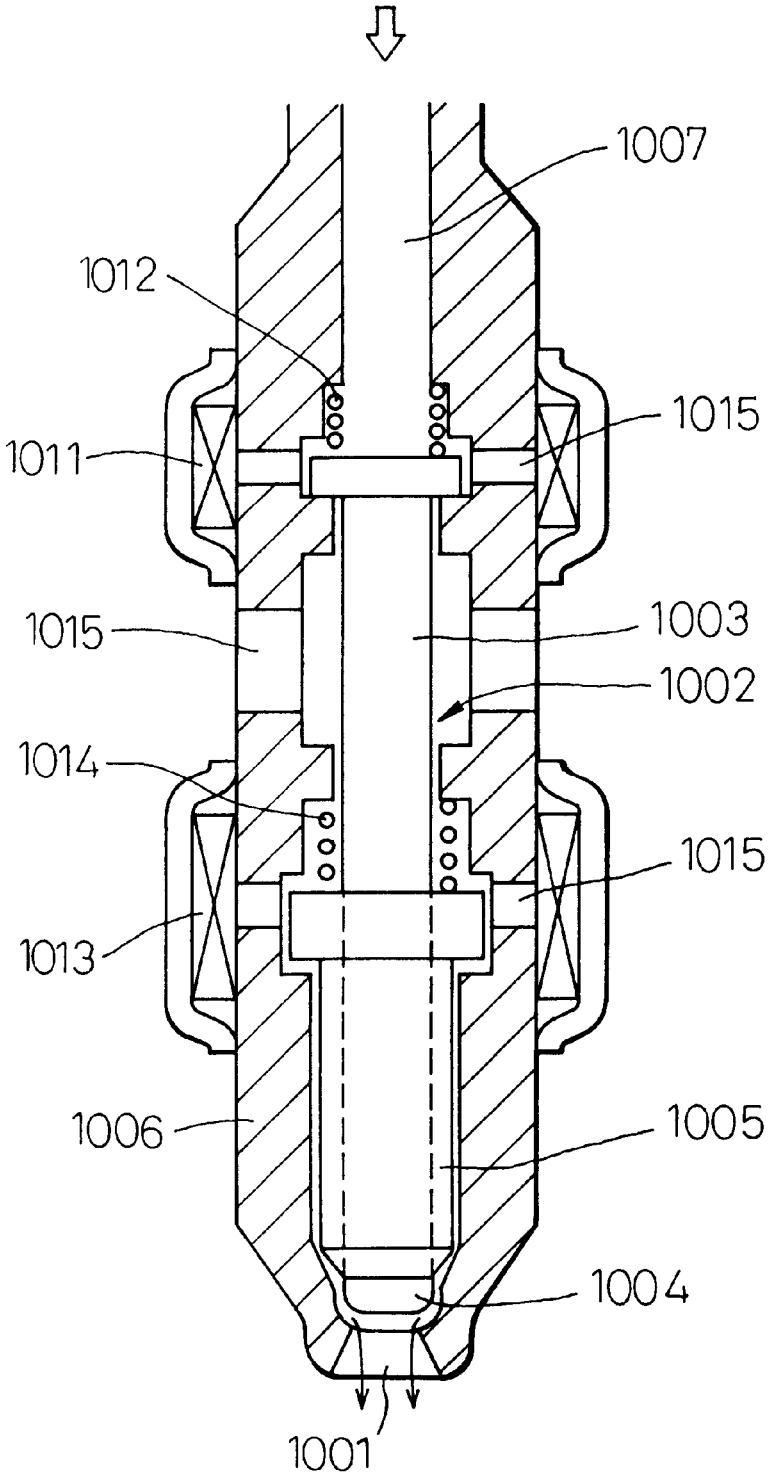
FIG. 14 shows an injector when a protruding amount of a tip of an inner member of a valve body with respect to an outer member is large.
Figure 15:
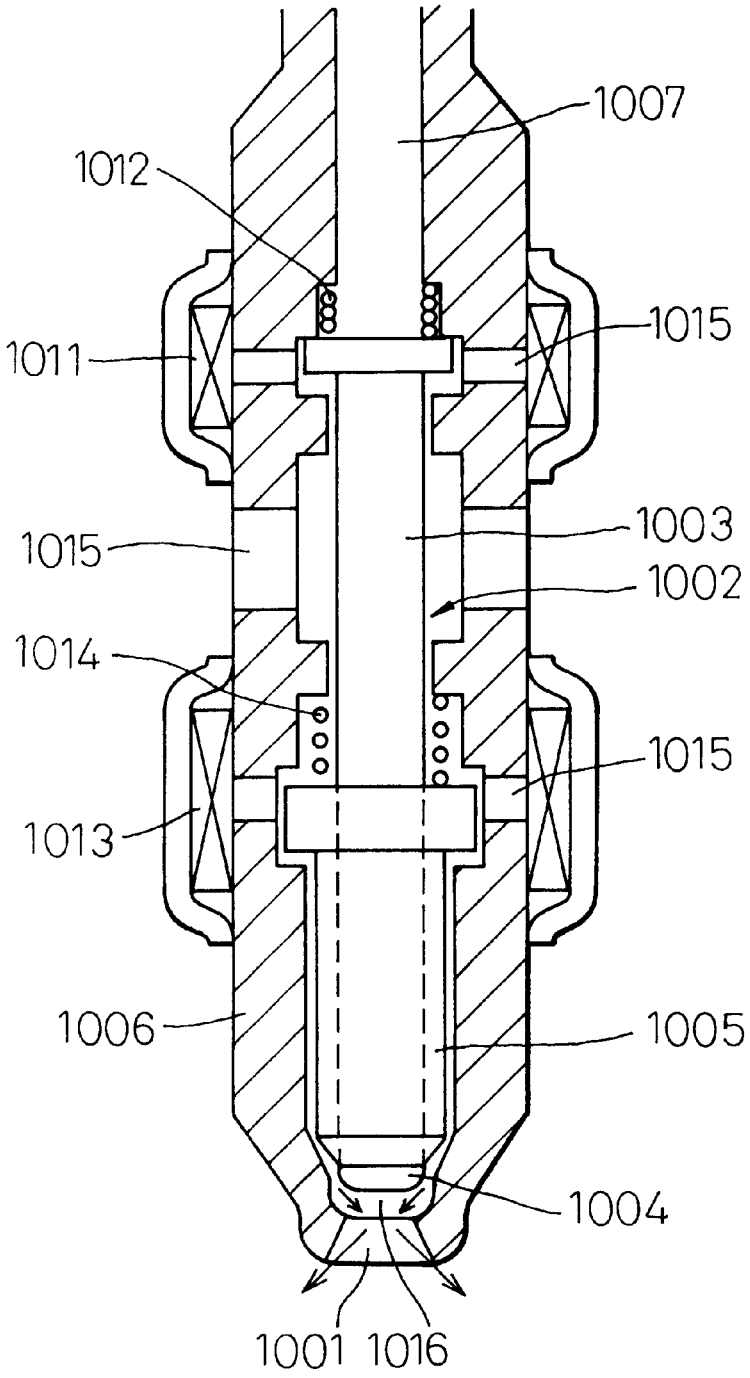
FIG. 15 shows the injector when the protruding amount of the tip of the inner member of the valve body with respect to the outer member is small.
Figure 16A:
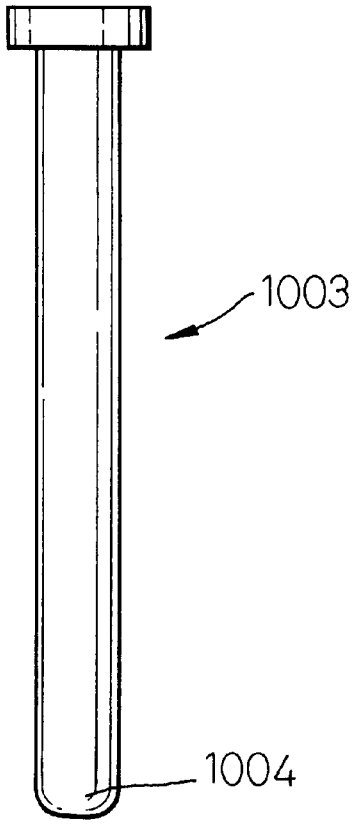
FIGS. 16A and 16B respectively show the inner member and the outer member of the valve body.
Figure 16B:
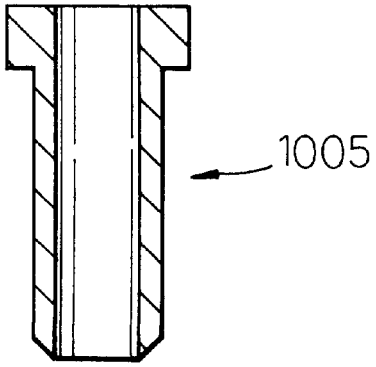

FIGS. 14 and 15 show partially sectional side views of a sixth embodiment of an injector of the present invention. Particularly, FIG. 14 shows the injector when a protruding amount of a tip of an inner member of a valve body with respect to an outer member is large. FIG. 15 shows the injector when the protruding amount of the tip of the inner member of the valve body with respect to the outer member is small. FIGS. 16A and 16B respectively show the inner member and the outer member of the valve body. In FIGS. 14, 15, 16A and 16B, numeral 1001 designates a nozzle hole, numeral 1002 designates a valve body for opening or closing the nozzle hole 1001, numeral 1003 designates the inner member of the valve body 1002. Numeral 1004 designates the tip of the inner member 1003, numeral 1005 designates the outer member of the valve body 1002, the outer member 1005 being located outside of the inner member 1003. Numeral 1006 designates an injection nozzle and numeral 1007 designates a fuel passage. Numeral 1011 designates an inner member solenoid for making a protruding amount of the tip 1004 of the inner member 1003 with respect to the outer member 1005 small. Numeral 1012 designates an inner member spring for pushing the inner member 1003 toward a direction in which the tip 1004 of the inner member 1003 protrudes with respect to the outer member 1005. Numeral 1013 designates an outer member solenoid for attracting the valve body 1002 toward a valve opening direction, particularly for attracting the outer member 1005 upward (FIGS. 14 and 15). Numeral 1014 designates an outer member spring for pushing the valve body 1002 toward a valve closing direction, particularly for pushing the outer member 1005 downward (FIGS. 14 and 15). Numeral 1015 designates a non-magnetic portion, numeral 1016 designates a fuel pooling portion.

As shown in FIG. 14, when the protruding amount of the tip 1004 of the inner member 1003 with respect to the outer member 1005 should be large during the valve opening period, energizing for the inner member solenoid 1011 is stopped, or an energizing amount is reduced. Therefore, the inner member 1003 is pushed downward by the inner member spring 1012, and the protruding amount of the tip 1004 of the inner member 1003 with respect to the outer member 1005 becomes large. In this case, a fuel flow through the nozzle hole 1001, which is parallel to a center axis of the injector, becomes strong, and a fuel flow divergent angle becomes small. Further, a momentum of the fuel flow is reduced by a resistance of an inner wall of the injection nozzle 1006 in the fuel pooling portion 1016 (FIG. 15), and a penetration power of the fuel spray is reduced.

On the other hand, as shown in FIG. 15, when the protruding amount of the tip 1004 of the inner member 1003 with respect to the outer member 1005 should be small during the valve opening period, the energizing amount for the inner member solenoid 1011 becomes larger than the case of FIG. 14. Therefore, the inner member 1003 is attracted upward by the inner member solenoid 1011, and the protruding amount of the tip 1004 of the inner member 1003 with respect to the outer member 1005 becomes small. In this case, a fuel flow through the nozzle hole 1001, which transverses the center axis of the injector, becomes strong, and the fuel flow divergent angle becomes large. Further, since the fuel does not flow along the inner wall of the injection nozzle 1006 in the pooling portion 1016, the momentum of the fuel flow is not reduced by the resistance of the inner wall of the injection nozzle 1006 in the fuel pooling portion 1016, and the penetration power of the fuel spray becomes larger than the case of FIG. 14.

When the protruding amount of the tip 1004 of the inner member 1003 with respect to the outer member 1005 should be changed in order to change the fuel spray divergent angle and the penetration power of the fuel spray, the energizing amount for the inner member solenoid 1011 is changed. That is, when the protruding amount of the tip 1004 of the inner member 1003 with respect to the outer member 1005 should be reduced, the energizing amount for the inner member solenoid 1011 is increased, and when the protruding amount of the tip 1004 of the inner member 1003 with respect to the outer member 1005 should be increased, the energizing amount for the inner member solenoid 1011 is reduced. The protruding amount of the tip 1004 of the inner member 1003 with respect to the outer member 1005 can be continuously changed by continuously changing the energizing amount for the inner member solenoid 1011.

According to the present embodiment, a relative position of the tip 1004 of the inner member 1003 of the valve body 1002 with respect to the outer member 1005 during the valve opening period is decided in accordance with a target shape of a fuel spray, and then the tip 1004 is located at the decided position. That is, the relative position of the tip 1004 of the inner member 1003 with respect to the outer member 1005 is changed in accordance with the target shape of the fuel spray without reference to a fuel supply pressure with respect to the injector. Therefore, even if the fuel supply pressure with respect to the injector does not change, the relative position of the tip 1004 of the inner member 1003 of the valve body 1002 with respect to the outer member 1005 can be changed in order to change the target shape of the fuel spray.

Further, a minimum cross section of the fuel passage during the valve opening period is defined by an inner surface of the injection nozzle 1006 and an outer surface of the outer member 1005 of the nozzle body 1002 without reference to the inner member 1003 of the valve body 1002. Therefore, the target shape of the fuel spray can be changed by changing the relative position of the tip 1004 of the inner member 1003 of the valve body 1002 with respect to the outer member 1005, while keeping a fuel injection rate constant.

Also, according to the present embodiment, the protruding amount of the tip 1004 of the inner member 1003 of the valve body 1002 with respect to the outer member 1005 during the valve opening period is selected by selecting the energizing amount for the inner member solenoid 1011. That is, the protruding amount of the tip 1004 with respect to the outer member 1005 is changed by changing the energizing amount for the inner member solenoid 1011 without reference to the fuel supply pressure with respect to the injector. Therefore, even if the fuel supply pressure with respect to the injector is not changed, the protruding amount of the tip 1004 of the inner member 1003 of the valve body 1002 with respect to the outer member 1005 can be changed.

Moreover, according to the present embodiment, the inner member solenoid 1011 is located on the opposite side of the inner member 1003 from the tip 1004 and outside of the outer member 1005. Therefore, the injector can prevent the fuel to be injected impinging on the inner member solenoid 1011, and the outer member 1005 of the valve body 1002 can be small.

Figure 17:
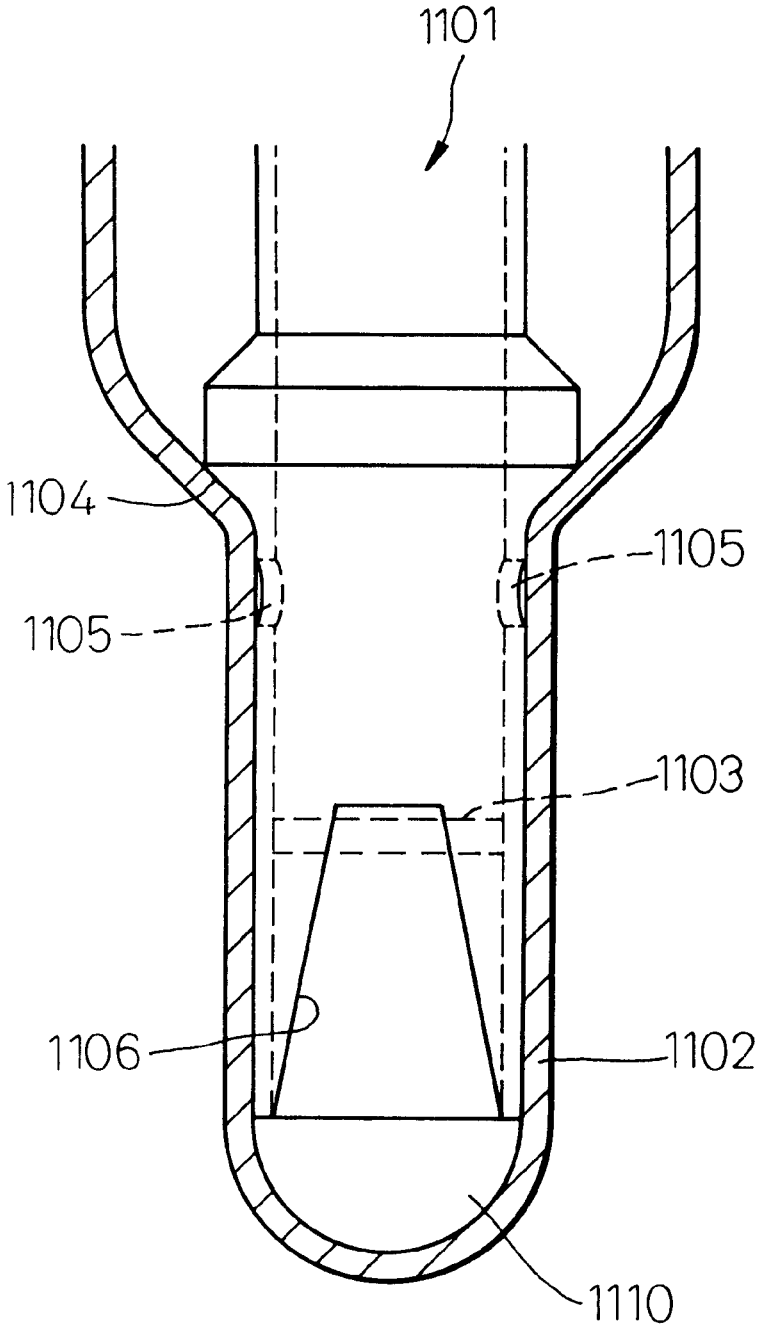
FIG. 17 shows the injector during the valve fully closing period.
Figure 18:
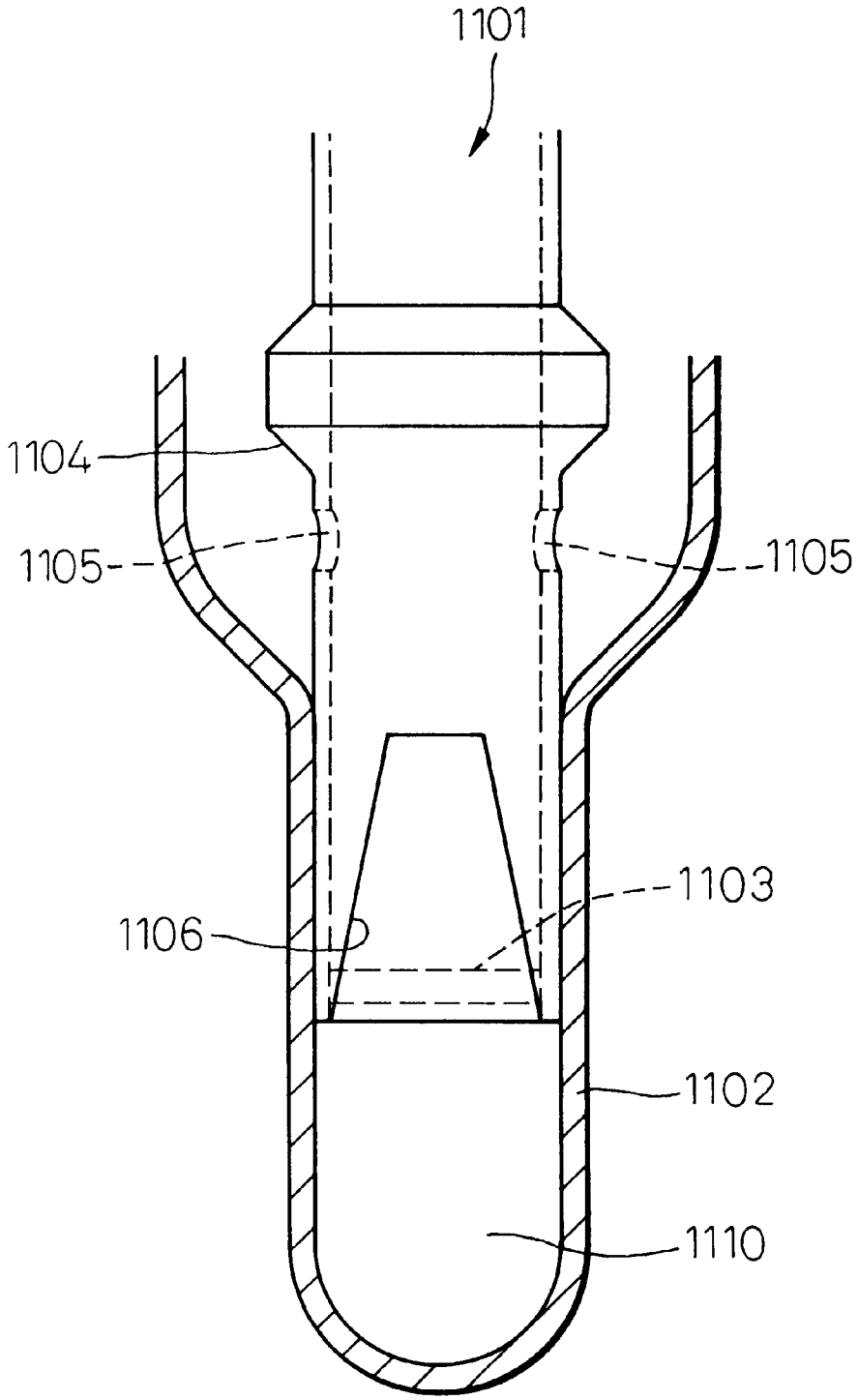
FIG. 18 shows the injector during the valve fully opening period.
Figure 19:
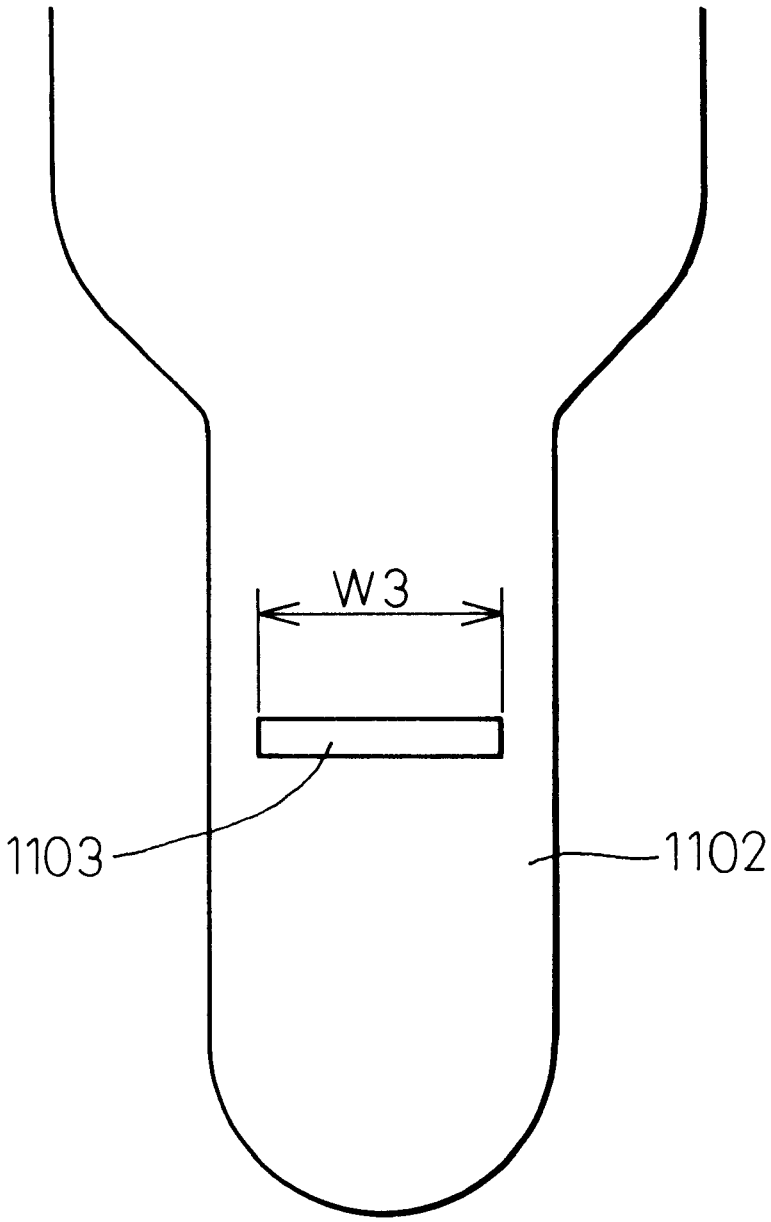
FIG. 19 is a side view of the injection nozzle.
Figure 20A:
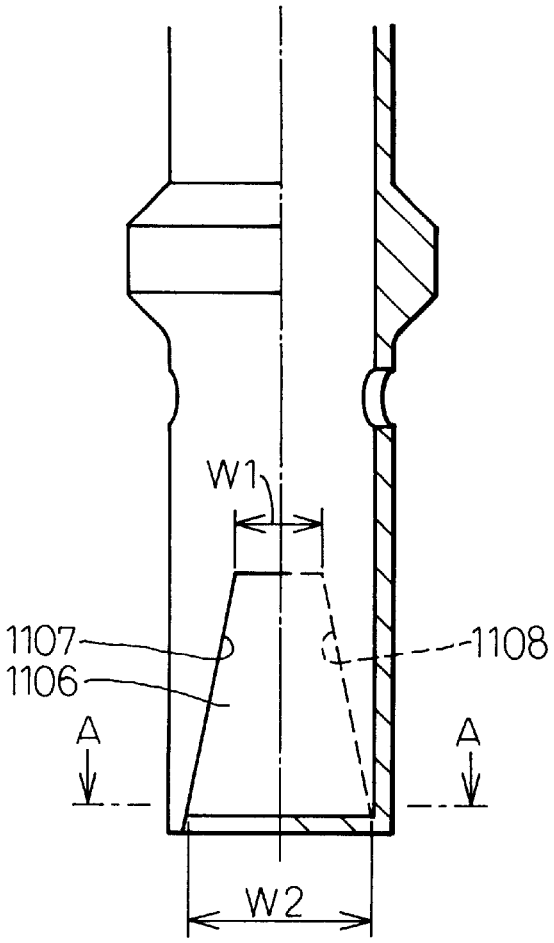
FIGS. 20A and 20B respectively show the valve body.
Figure 20B:
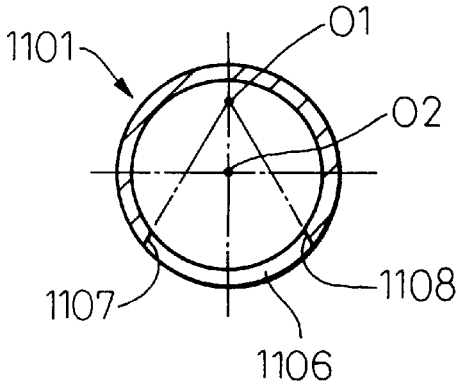
Figure 21A:
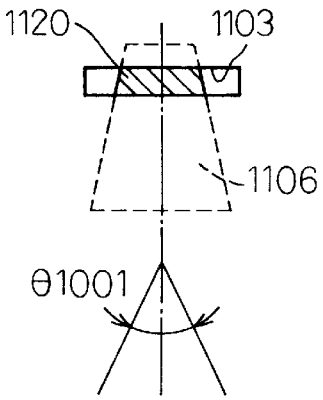
FIGS. 21A to 21C respectively show relations between a lift amount of the valve body and a fuel spray divergent angle.
Figure 21B:
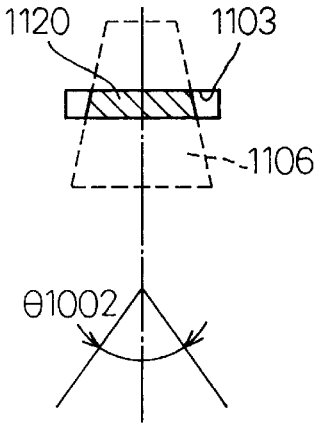
Figure 21C:
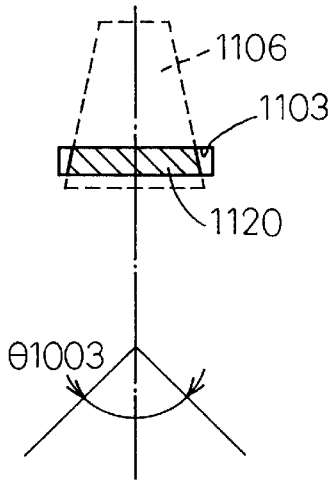

FIGS. 17 and 18 show partially sectional side views of a seventh embodiment of an injector of the present invention. Particularly, FIG. 17 shows the injector during the valve fully closing period. FIG. 18 shows the injector during the valve fully opening period. FIG. 19 is a side view of an injection nozzle. FIGS. 20A and 20B respectively show a valve body. Particularly, FIG. 20A is a partially sectional side view of the valve body. FIG. 20B is a cross sectional cut along line A—A in FIG. 20A. FIGS. 21A to 21C respectively show relations between a lift amount of the valve body and a fuel spray divergent angle. In FIGS. 17, 18, 19, 20A, 20B, 21A, 21B and 21C, numeral 1101 designates a hollow valve body, numeral 1102 designates an injection nozzle, numeral 1103 designates a slit nozzle hole of the injection nozzle 1102, and numeral 1104 designates a seal portion of the valve body 1101. Numeral 1105 designates first openings located downstream (lower side in FIG. 17) of the seal portion 1104 for allowing a fuel to be injected, to flow into an inside of the valve body 1101. Numeral 1106 designates a substantially trapezoidal second opening for allowing the fuel, which flows from the first openings, to flow out of the valve body 1002. Numeral 1107 designates a left side wall of the second opening 1106, numeral 1108 designates a right side wall of the second opening 1106, numeral 1120 designates an overlapping area of the second opening 1106 and the slit nozzle hole 1103. Numeral W1 designates an upstream width of the second opening 1106, numeral W2 designates a downstream width of the second opening 1106, and numeral W3 designates a width of the slit nozzle hole 103. Numeral O1 designates an intersection point of an extension line from a surface of the left side wall 1107 of the second opening 1106 and an extension line from a surface of the right side wall 1108. Numeral O2 designates a center axis of the valve body 1101, and numerals O1, O2 and O3 respectively designate fuel spray divergent angles. The lift amount of the valve body 1101 is controlled by the solenoid 1013 as shown in FIG. 14.

While the valve body 1101 is located on a fully closing position, the fuel flow is shut by the seal portion 1104 as shown in FIG. 17, and therefore, the fuel is not injected from the nozzle hole 1103. Then, as an energizing amount for the valve body lifting solenoid is increased, the valve body 1101 is moved upward. When the fuel flow is not shut by the seal portion 1104, the fuel flows through the first openings 1105, and flows into the inside of the hollow valve body 1101. And then, the fuel flows through the second opening 1106 and the slit nozzle hole 1103, and is injected out of the injector, as shown in FIG. 18.

As shown in FIGS. 19, 20A and 20B, the upstream width W1 of the second opening 1106 is smaller than the downstream width W2 of the second opening 1106, and is smaller than the width W3 of the slit nozzle hole 1103 of the injection nozzle 1102. Therefore, as the lift amount of the valve body 1101 becomes larger, a width of the overlapping area 120 (hatched area in FIGS. 21A to 21C) of the second opening 1106 and the slit nozzle hole 1103 becomes larger, and the fuel divergent angle θ1, θ2, θ3 becomes larger (from FIG. 21A to FIG. 21C).

According to the present embodiment, a shape of the overlapping area 120 (hatched area in FIGS. 21A to 21C) of the second opening 1106 and the slit nozzle opening 1103 is changed on the basis of the lift amount of the valve body 1101. Therefore, the target shape of the fuel spray can be changed by a method which is different from the prior art method. Particularly, the overlapping area 1120 of the slit nozzle hole 1103 of the injection nozzle 1102 and the second opening 1106 of the valve body 1101 increases by increasing the lift amount of the valve body 1101. Therefore, the shape of the fuel spray can be changed by changing the lift amount of the valve body 1101 and changing the overlapping area 1120 of the slit nozzle hole 1103 and the second opening 1106.

Further, according to the present embodiment, during the valve opening period, i.e., after a valve opening motion is completed, the minimum cross section of the fuel passage is defined by the first openings 1105 of the valve body 1101, without reference to a change of the overlapping area 1120 of the slit nozzle hole 1103 and the second opening 1106. That is, in the present embodiment, a sum of area of the two first openings 1105 is smaller than the overlapping area 1120 of the slit nozzle hole 1103 and the second opening 1106 when the overlapping area 1120 is the smallest as shown in FIG. 17. Therefore, the shape of the fuel spray can be changed by changing the lift amount of the valve body 1101 and changing the overlapping area 1120 of the slit nozzle hole 1103 and the second opening 1106, while keeping the fuel injection rate constant.

Moreover, according to the present embodiment, the width of the second opening 1106 becomes gradually smaller as a position in which the width of the second opening 1106 is measured shifts from downstream to upstream. Therefore, as the lift amount of the valve body 1101 increases, the width of the overlapping area 1120 of the slit nozzle hole 1103 and the second opening 1106 increases. Accordingly, the injector can gradually increase the fuel spray divergent angle θ1, θ2, θ3 by gradually increasing the lift amount of the valve body 1101.

Also, according to the present embodiment, the intersection point O1 of the extension line from the surface of the left side wall 1107 of the second opening 1106 and the extension line from the surface of the right side wall 1108 of the second opening 1106 is located on the opposite side of the center line O2 of the valve body 1101 from the second opening 1106, as shown in FIG. 20B. Therefore, the fuel flowing inside of the valve body 1101 can more easily flow into the second opening 1106 than if the intersection point is located near the second opening. Accordingly, the injector can form the fuel spray whose turbulence is smaller than if the intersection point is located near the second opening.

An eighth embodiment of an injector of the present invention will be explained. Although a size of the overlapping area 1120 of the slit nozzle hole 1103 and the second opening 1106 is changed when the lift amount of the valve body is changed from a zero lift amount to a maximum lift amount in the seventh embodiment, in the present embodiment, a size of an overlapping area of a slit nozzle hole and a second opening is changed when a maximum lift amount of a valve body is changed. A constitution of the present embodiment is substantially the same as a constitution of the seventh embodiment.

Figure 22A:
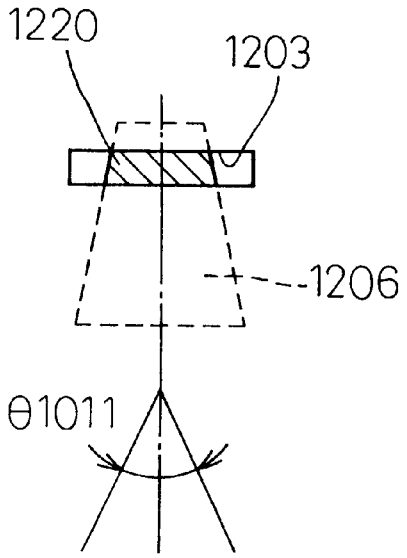
FIGS. 22A and 22B respectively show relations between a maximum lift amount of the valve body and a fuel spray divergent angle.
Figure 22B:
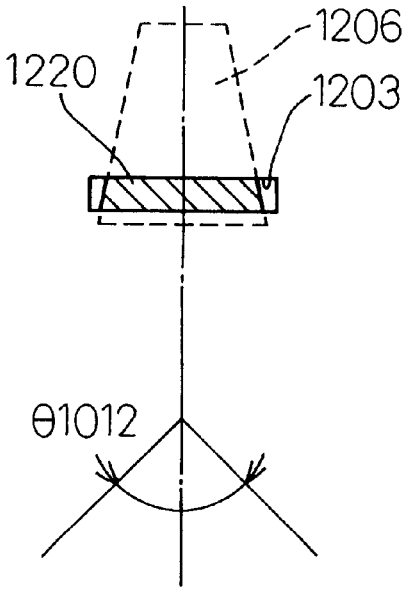

FIGS. 22A and 22B respectively show relations between a maximum lift amount of the valve body and a fuel spray divergent angle. In FIGS. 22A and 22B, numeral 1203 designates a slit nozzle hole of the injection nozzle, numeral 1206 designates a substantially trapezoidal second opening for allowing the fuel, which flows from the first openings, to flow out of the valve body. Numeral 1220 designates an overlapping area of the second opening 1206 and the slit nozzle hole 1203. A maximum lift amount of the valve body is controlled by changing a position of an abutment cam located on an upper end of the valve body. In another embodiment, a maximum lift amount of the valve body may be changed by changing an energizing amount of a solenoid for attracting the valve body toward a valve opening direction.

As shown in FIG. 22A, when the maximum lift amount of the valve body is small, a width of the overlapping area 1220 (hatched area in FIG. 22A) of the second opening 1206 and the slit nozzle hole 1203 is relatively small, and therefore, a fuel spray divergent angle θ11 is relatively small. As shown in FIG. 22B, when the maximum lift amount of the valve body becomes larger, the width of the overlapping area 1220 (hatched area in FIG. 22B) of the second opening 1206 and the slit nozzle hole 1203 becomes larger, and therefore, the fuel spray divergent angle θ12 becomes larger.

Figure 23A:
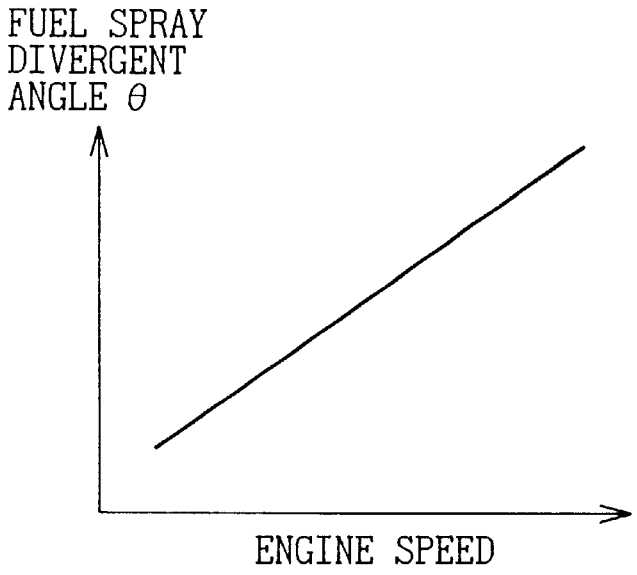
FIGS. 23A and 23B respectively show a relation between an engine speed and a fuel spray divergent angle, and a relation between an engine load and a fuel spray divergent angle during a stratified combustion of an internal combustion engine.
Figure 23B:
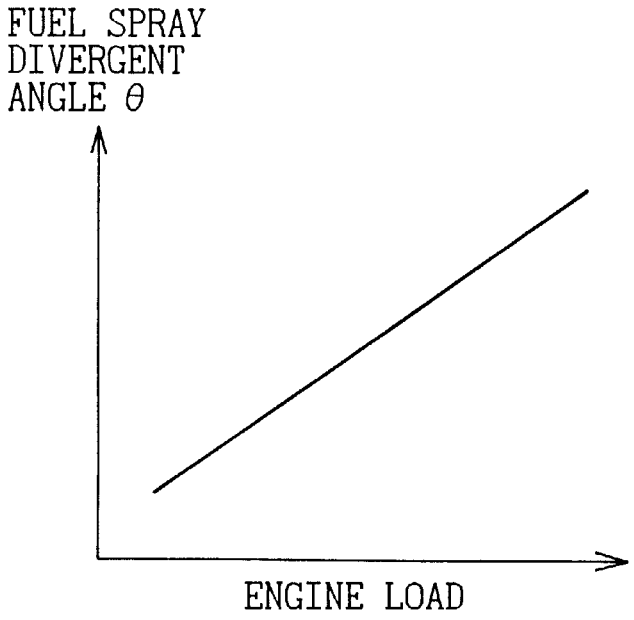

FIGS. 23A and 23B respectively show a relation between an engine speed and a fuel spray divergent angle, and a relation between an engine load and a fuel spray divergent angle during a stratified combustion of an internal combustion engine. AS shown in FIGS. 23A and 23B, in the present embodiment, as the engine speed increases, the maximum lift amount of the valve body is increased, and therefore, the fuel spray divergent angle θ is increased. That is, an overlean area around a sparking plug is prevented by making the fuel spray divergent angle θ small when the engine speed and the engine load are low, and therefore, a misfire is prevented during an idling operation. Also, an overrich area around the sparking plug is prevented by making the fuel spray divergent angle θ large when the engine speed and the engine load are high, and therefore, an air fuel ratio can be locally stabilized. Therefore, a stabilization of a combustion is increased.

Figure 24A:
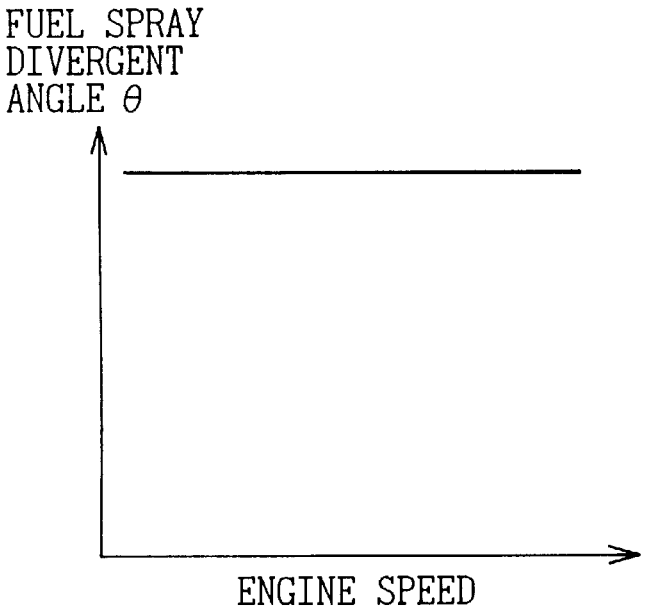
FIGS. 24A and 24B respectively show a relation between an engine speed and a fuel spray divergent angle, and a relation between an engine load and a fuel spray divergent angle during a homogeneous combustion of the internal combustion engine.
Figure 24B:
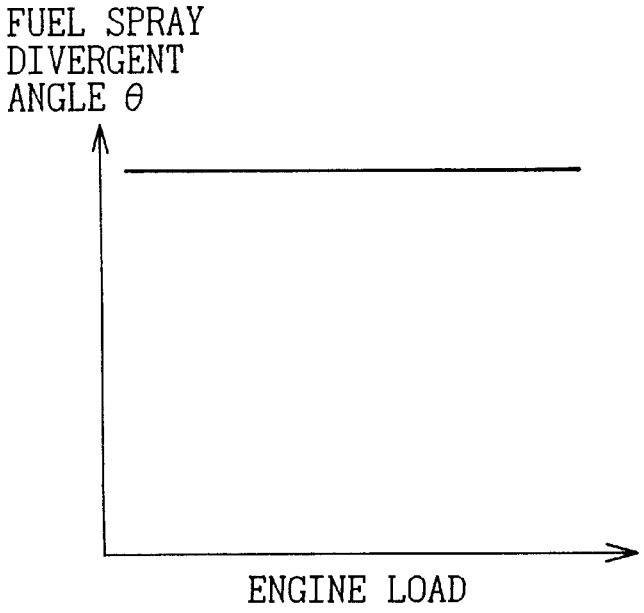

FIGS. 24A and 24B respectively show a relation between an engine speed and a fuel spray divergent angle, and a relation between an engine load and a fuel spray divergent angle during a homogeneous combustion of the internal combustion engine. As shown in FIGS. 24A and 24B, in the present embodiment, the maximum lift amount of the valve body is kept at a maximum, and the fuel spray divergent angle θ is kept at a maximum, without reference to the engine speed. Also, the maximum lift amount of the valve body is kept at a maximum, and the fuel spray divergent angle θ is kept at a maximum, without reference to the engine load. That is, a mixing of all air and a fuel is accelerated by keeping the fuel spray divergent angle θ at a maximum without reference to the engine speed or the engine load, and therefore, an air utilization rate is increased over all engine speed and engine load. Accordingly, fuel consumption and power can be increased.

Figure 25:
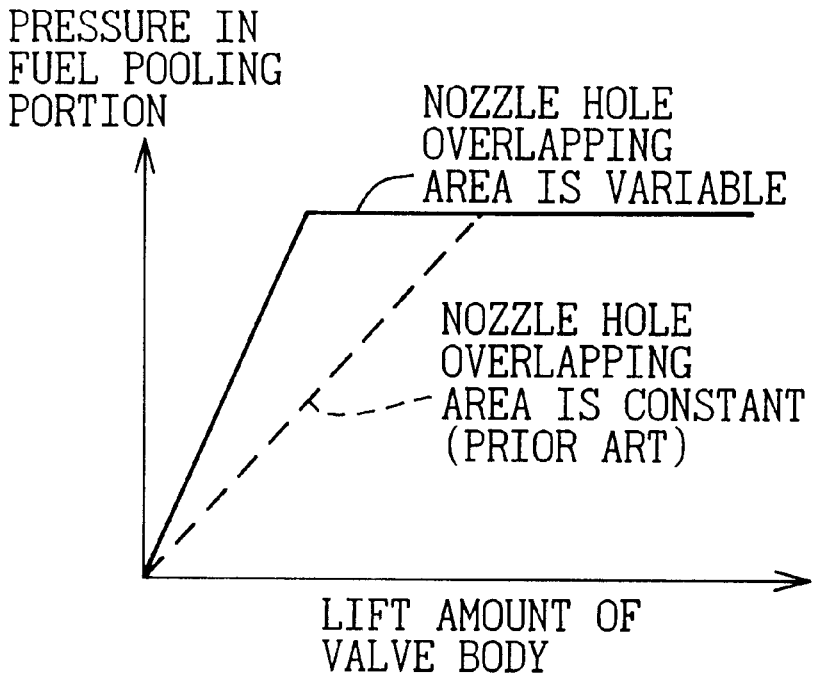
FIG. 25 shows a relation between a lift amount of the valve body and a pressure in a fuel pooling portion.

FIG. 25 shows a relation between the lift amount of the valve body and a pressure in a fuel pooling portion. As shown in FIG. 25, if the overlapping area 1220 of the second opening 1206 and the slit nozzle hole 1203 is increased in accordance with an increase of the lift amount of the valve body like as the present embodiment, the overlapping area 1220 is made relatively small when the lift amount of the valve body is small. Therefore, a pressure in a fuel pooling portion can be quickly increased (solid line in FIG. 25). On the other hand, if an area of a nozzle hole is fixed as in the prior art, the area of the nozzle hole is relatively large even when a lift amount of a valve body is small. Therefore, a relatively long time is required to increase a pressure in a fuel pooling portion (dotted line in FIG. 25). Accordingly, the fuel spray can be fine even when the fuel injection is in an initial step, by quickly increasing the pressure in the fuel pooling portion as in the present invention.

According to the present embodiment, the injector further has an advantageous effect which is substantially the same as the advantageous effect of the seventh embodiment.

Figure 26:
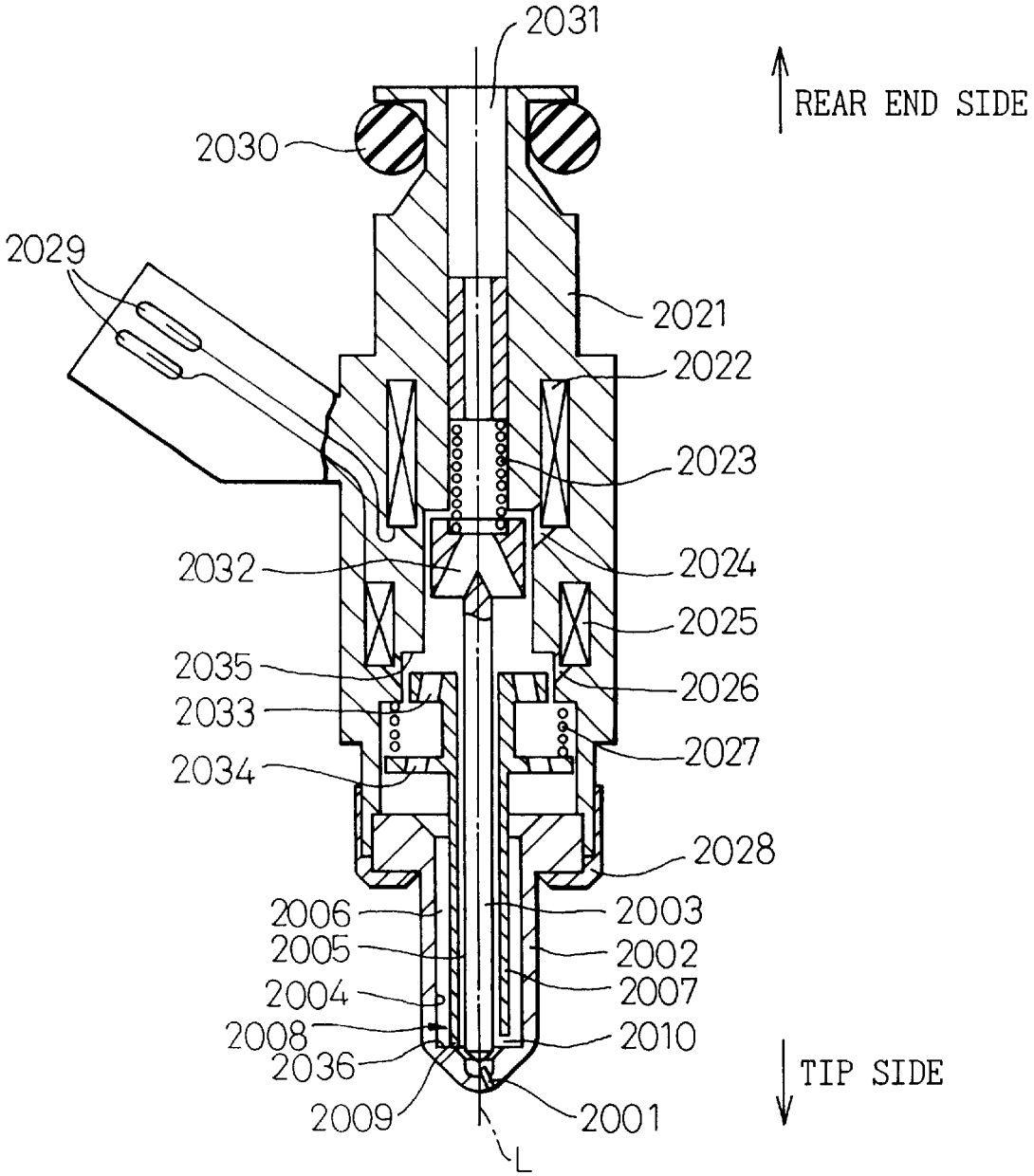
FIG. 26 is a partially sectional side view of a ninth embodiment of the injector of the present invention, the injector being applied to a direct injection type engine.
Figure 27:
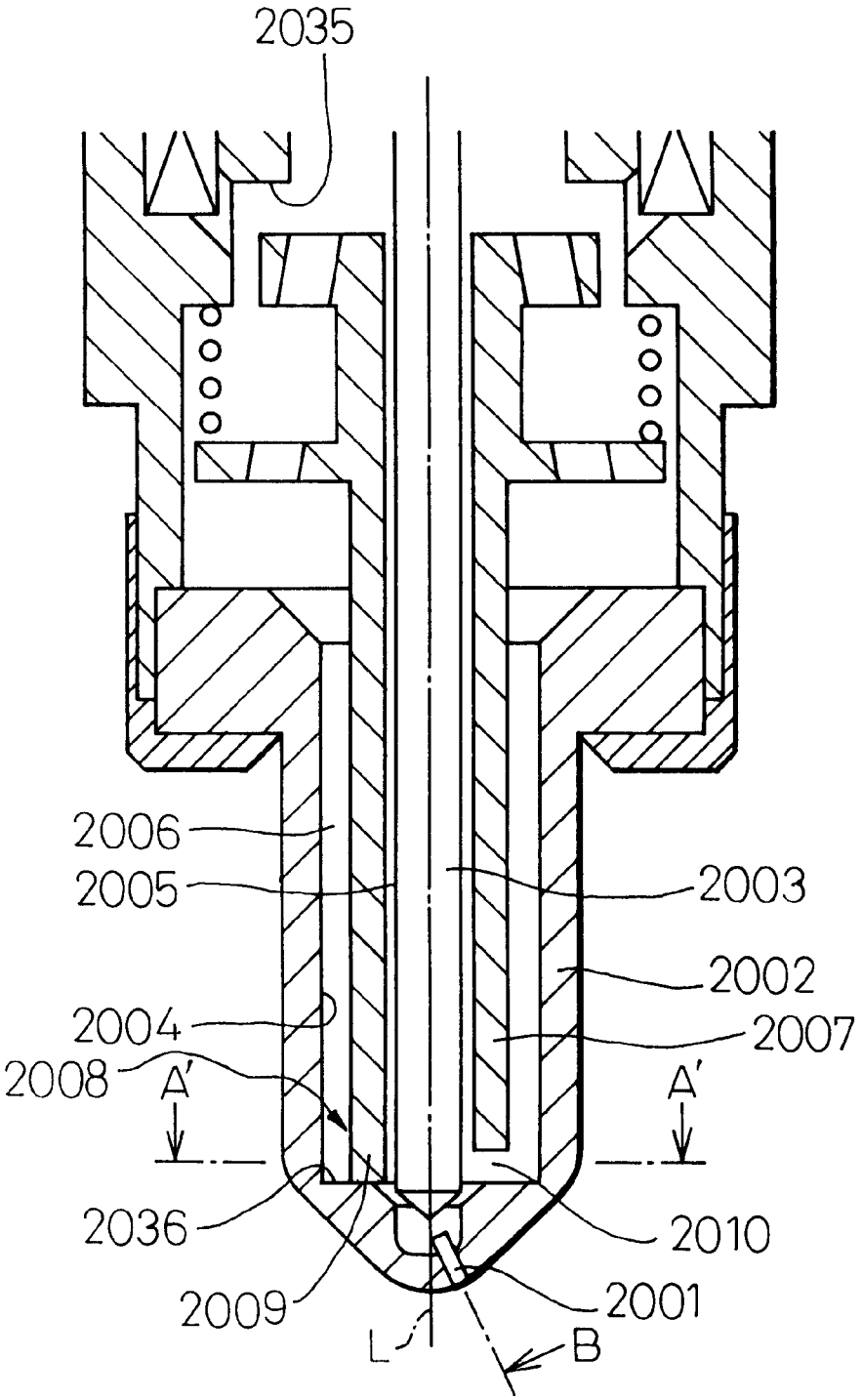
FIG. 27 is an enlarged view of FIG. 26.
Figure 28A:
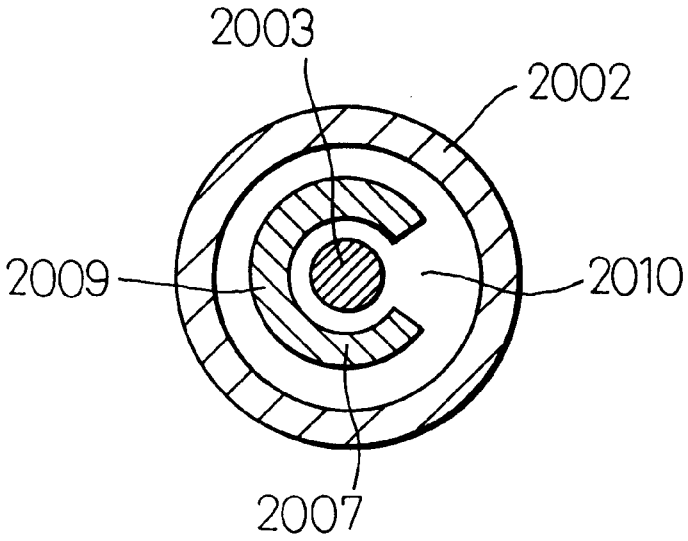
FIGS. 28A and 28B respectively show sectional views of FIG. 27.
Figure 28B:
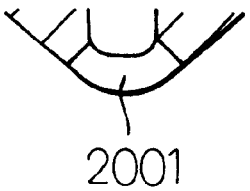

FIG. 26 is a partially sectional side view of a ninth embodiment of an injector of the present invention, the injector being applied to a direct injection type engine. FIG. 27 is an enlarged view of FIG. 26. FIGS. 28A and 28B respectively show sectional views of FIG. 27. Particularly, FIG. 28A is a sectional view cut along line A'—A' in FIG. 27. FIG. 28B is a sectional view cut along line B. In FIGS. 26, 27, 28A and 28B, numeral 2001 designates a slit nozzle hole, numeral 2002 designates an injection nozzle with the nozzle hole 2001, numeral 2003 designates a valve body for opening or closing the nozzle hole 2001, numeral 2004 designates a nozzle inner surface, numeral 2005 designates a valve body outer surface, and numeral 2006 designates a fuel passage defined by the nozzle inner surface 2004 and the valve body outer surface. Numeral 2007 designates a cylindrical fuel flow controlling member located on a tip side of the valve body 2003 in the fuel passage 2006 for controlling a fuel flow in the fuel passage 2006. The fuel flow in the fuel passage 2006 is changed by moving the fuel flow controlling member 2007 along a center axis L of the injector independently of the valve body 2003.

Numeral 2008 designates a tip portion of the fuel flow controlling member 2007, numeral 2009 designates a seal portion constituting a part of the tip portion 2008 and numeral 2010 designates a notch constituting another part of the tip portion 2008. An outer surface of the fuel flow controlling member 2007 is communicated with an inner surface of the fuel flow controlling member 2007 by the notch 2010. Particularly, as shown in FIG. 28A, the tip portion 2008 of the fuel flow controlling member 2007 is asymmetric because of the seal portion 2009 and the notch 2010. Further, the notch 2010 extends perpendicularly with respect to the inner surface and the outer surface of the fuel flow controlling member 2007, i.e., the notch 2010 extends radially. Although only one notch 2010 is provided, a plurality of notches may be provided in another embodiment.

Returning to the present embodiment, numeral 2021 designates an injector body, numeral 2022 designates a first solenoid for attracting the valve body 2003 toward a valve opening direction, numeral 2023 designates a spring for pushing the valve body 2003 toward a valve closing direction and numeral 2024 designates a non-magnetic ring. Numeral 2025 designates a second solenoid for attracting the fuel flow controlling member 2007 toward a rear end side (FIG. 26), numeral 2026 designates a non-magnetic ring, numeral 2027 designates a spring for pushing the fuel flow controlling member 2007 toward a tip side (FIG. 26). As an energizing amount for the second solenoid 2025 is increased, the fuel flow controlling member 2007 is moved toward the rear end side (FIG. 26). On the other hand, as the energizing amount for the second solenoid 2025 is decreased, the fuel flow controlling member 2007 is moved toward the tip side (FIG. 26). That is, a position in which the fuel flow controlling member 2007 is held is continuously controlled by continuously controlling the energizing amount for the second solenoid 2025. Numeral 2028 designates a retaining nut, numeral 2029 designates a socket, numeral 2030 designates an O-ring, numeral 2031 designates a fuel introducing hole, numerals 2032, 2033 and 2034 designate a fuel passage, numeral 2035 designates a fuel flow controlling member stop, and numeral 2036 designates a fuel flow controlling member seat surface. When the seal portion 2009 is abutted against the seat surface 2036, a cross section of the fuel passage defined by the notch 2010 is decreased to a cross section which is substantially the same as a cross section of the nozzle hole 2001.

Figure 29A:
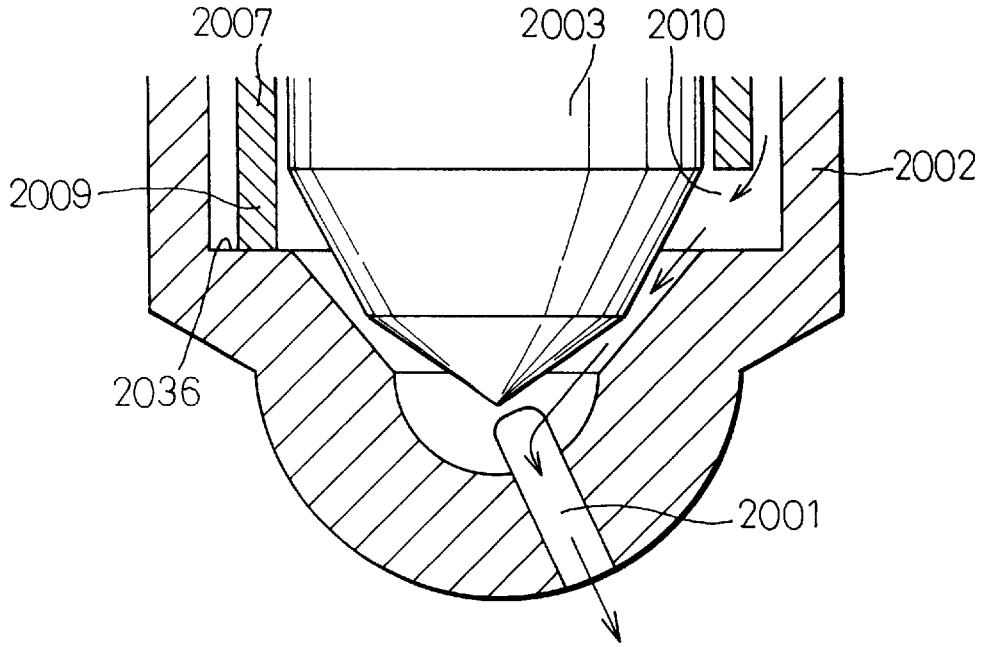
FIGS. 29A and 29B respectively show a fuel flow while a seal portion 2009 is abutted against a seat surface 2036.
Figure 29B:
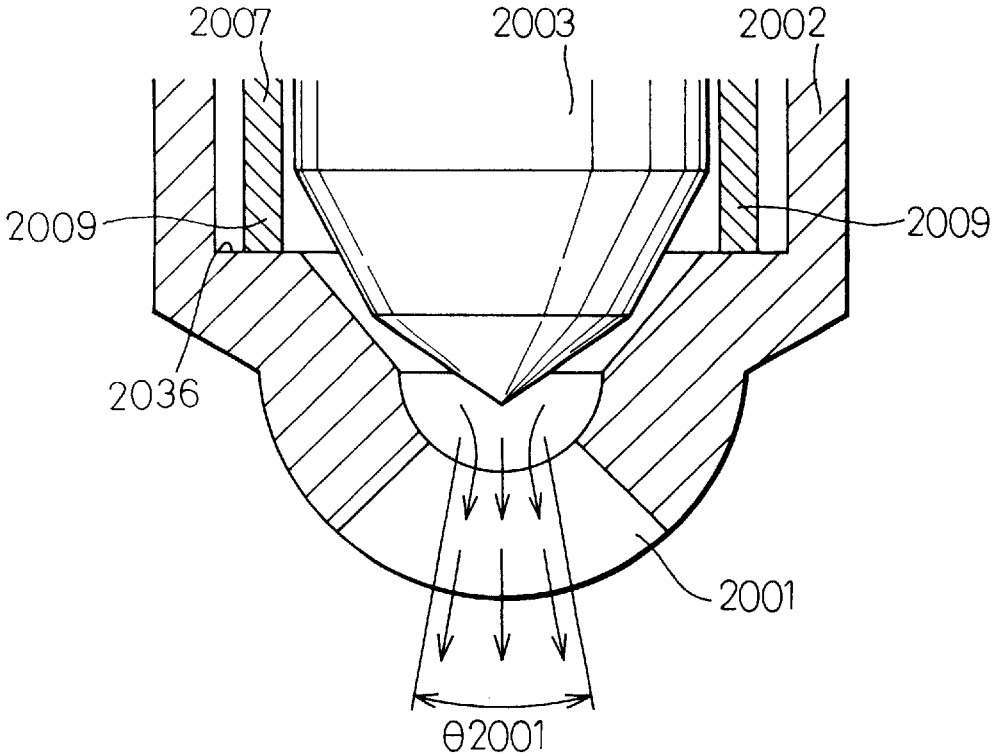
Figure 30A:
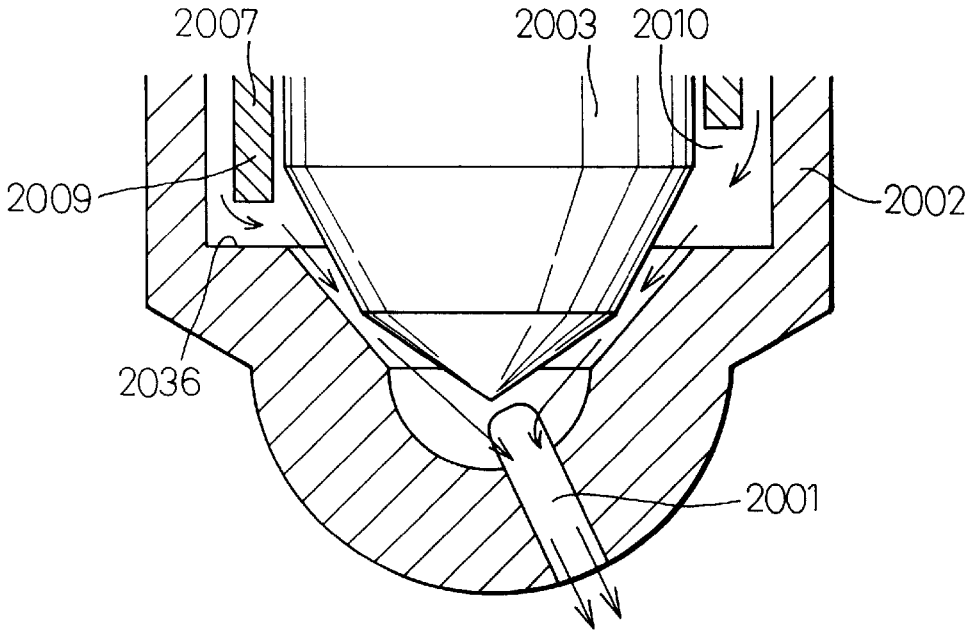
FIGS. 30A and 30B respectively show a fuel flow while the seal portion 2009 is not abutted against the seat surface 2036.
Figure 30B:
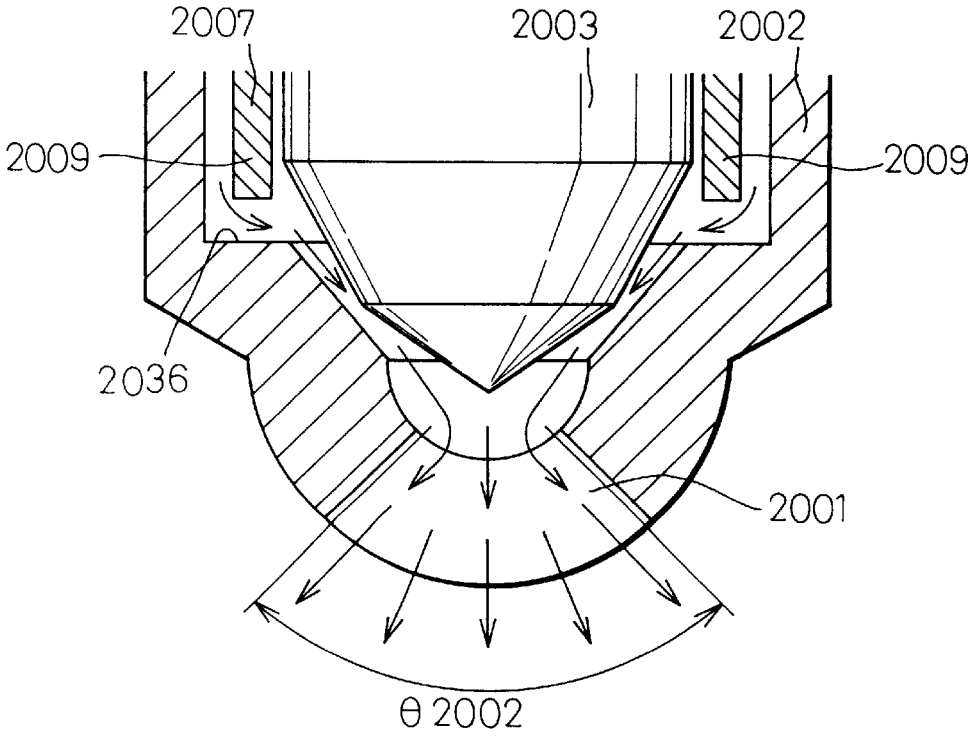

FIGS. 29A and 29B respectively show a fuel flow while a seal portion 2009 is abutted against a seat surface 2036. FIGS. 30A and 30B respectively show a fuel flow while the seal portion 2009 is not abutted against the seat surface 2036. Particularly, FIGS. 29A and 30A are views seen from the same direction as FIGS. 26 and 27. FIGS. 29B and 30B are views seen from a direction which is perpendicular with respect to a longitudinal direction of the slit nozzle hole 2001. As shown in FIGS. 29A and 29B, when the energizing of the second solenoid 2025 is stopped and the seal portion 2009 is abutted against the seat surface 2036, the fuel flows into the nozzle hole 2001 through only the notch 2010. Accordingly, since a fuel which flows into the nozzle hole 2001 along the longitudinal direction of the slit nozzle hole 2001 (along a lateral direction of FIG. 29B) does not exist, a fuel spray divergent angle θ1 becomes relatively small. On the other hand, as shown in FIGS. 30A and 30B, when the second solenoid 2025 is energized and a gap is formed between the seal portion 2009 and the seat surface 2036, the fuel flows into the nozzle hole 2001 through both the gap and the notch 2010. Accordingly, since a fuel flows into the nozzle hole 2001 along the longitudinal direction of the slit nozzle hole 2001 (along a lateral direction of FIG. 30B), a fuel spray divergent angle θ2 becomes larger than the fuel spray divergent angle θ1 of FIG. 29B. If the gap between the seal portion 2009 and the seat surface 2036 becomes smaller than the gap shown in 30B, the fuel spray divergent angle becomes smaller than the fuel spray divergent angle θ2 shown in FIG. 30B and becomes larger than the fuel spray divergent angle θ1 shown in FIG. 29B. That is, the fuel spray divergent angle can be continuously controlled by continuously controlling the energizing amount for the second solenoid 2025.

According to the present embodiment, the fuel flow in the fuel passage 2006 defined by the injection nozzle inner surface 2004 and the valve body outer surface 2005 is changed by moving the fuel flow controlling member 2007 in the fuel passage 2006 along the center axis L of the injector. Therefore, the shape of the fuel spray can be changed. That is, even if the lift amount of the valve body 2003 is not changed, the injector can change the fuel flow in the fuel passage 2006 and the nozzle hole 2001 and change the shape of the fuel spray by moving the fuel flow controlling member 2007 along the center axis L of the injector.

Further, according to the present embodiment, the cylindrical fuel flow controlling member 2007 which is movable independently of the valve body 2003 is located on the tip side of the valve body 2003 in the fuel passage 2006, and at least one notch 2010 for communicating with the outer periphery and the inner periphery of the cylindrical fuel flow controlling member 2007 is located at the tip portion 2008 of the cylindrical fuel flow controlling member 2007. Therefore, the fuel flow in the fuel passage 2006 can be changed by moving the cylindrical fuel flow controlling member 2007 having the notch 2010 in the fuel passage 2006. Accordingly, the shape of the fuel spray can be changed. That is, even if the lift amount of the valve body 2003 is not changed, the injector can change the fuel flow in the fuel passage 2006 and the nozzle hole 2001 and change the shape of the fuel spray by moving the cylindrical fuel flow controlling member 2007 which is movable independently of the valve body 2003. Further, since the cylindrical fuel flow controlling member 2007 is located on the tip side of the valve body 2003 in the fuel passage 2006, and the notch 2010 is located at the tip portion 2008 of the cylindrical fuel flow controlling member 2007, the fuel which flows through the slit nozzle hole 2001 is more advantageously changed, and therefore, the shape of the fuel spray can be changed, wherein changing the shape of the fuel spray includes both changing the fuel spray divergent angle and changing the fuel injection direction.

Although the nozzle hole 2001 is the slit in the present embodiment, in another embodiment, the nozzle hole may be completely circular or elliptic. Preferably, the nozzle hole is not completely circular, but is oblate, such as elliptic or slit in order that the shape of the fuel spray is more advantageously changed.

Also, according to the present embodiment, the fuel flow controlling member 2007 is moved such that the cross section of the fuel passage is decreased to the cross section of the nozzle hole, i.e., such that the seat portion 2009 is abutted against the seal surface 2036. Therefore, the fuel injection rate can be decreased. For example, even if the fuel injection period cannot be decreased, the fuel injection amount can be decreased. Further, according to the present embodiment, the tip of the fuel flow controlling member 2007 is comprised of the seal portion 2009 and the notch 2010, and the shape of the tip of the fuel flow controlling member 2007 is asymmetric. Therefore, a portion in which the fuel cannot easily flow and a portion in which the fuel can easily flow can be provided in the fuel passage 2006 defined by the injection nozzle inner surface 2004 and the valve body outer surface 2005. Accordingly, a position of the portion in which the fuel cannot easily flow and a position of the portion in which the fuel can easily flow can be changed by changing a position of the fuel flow controlling member 2007 along the center axis L of the injector. That is, when the seat portion 2009 is abutted against the seal surface 2036, only the notch 2010 corresponds to the portion in which the fuel can easily flow. On the other hand, when the seat portion 2009 is not abutted against the seal surface 2036, both the notch 2010 and the seat portion 2009 correspond to the portion in which the fuel can easily flow. As a result, the fuel which flows through the fuel passage 2006 and the slit nozzle hole 2001 can be advantageously changed, and the shape of the fuel spray can be changed.

Moreover, according to the present embodiment, the cylindrical fuel flow controlling member 2007 having the notch 2010 at the tip portion 2008 is moved in a moving direction of the valve body 2003, i.e., is moved in a direction which is the same as a direction of the center axis L of the injector. Therefore, the shape of the fuel spray can be changed by making the fuel flow into the slit nozzle hole 2001 circumferentially non-uniform when the lift amount of the cylindrical fuel flow controlling member 2007 is made small and the seat portion 2009 is abutted against the seal surface 2036, and by making the fuel flow into the slit nozzle hole 2001 circumferentially relatively uniform when the lift amount of the cylindrical fuel flow controlling member 2007 is made large and the seat portion 2009 is not abutted against the seal surface 2036.

Figure 31:
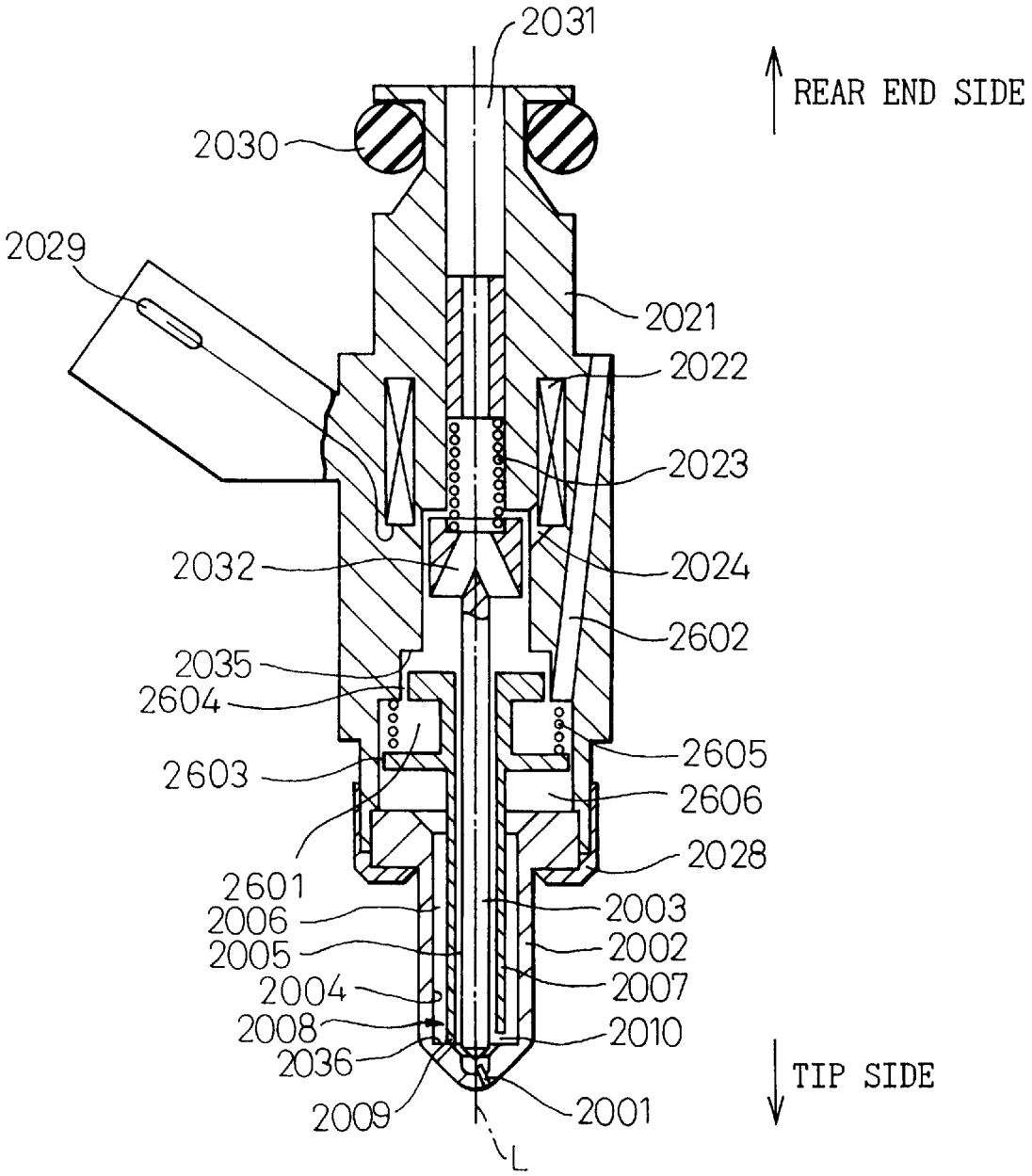
FIG. 31 is a partially sectional side view of an another embodiment of the injector of the present invention, the injector being applied to a direct injection type engine.

Although the fuel flow controlling member 2007 is moved by the second solenoid 2025 in the present embodiment, in another embodiment, a fuel flow controlling member may be moved by changing a fuel supply pressure. FIG. 31 is a partially sectional side view of an another embodiment of an injector of the present invention, the injector being applied to a direct injection type engine. In FIG. 31, numeral 2601 designates a low pressure chamber, a fuel being supplied to the low pressure chamber 2601 through a fuel passage 2602. The low pressure chamber 2601 is sealed from the fuel passages 2006, 2032 by seal portions 2603, 2604. Numeral 2605 designates a spring for pushing the fuel flow controlling member 2007 downward (FIG. 31). If a fuel pressure in a high pressure chamber 2606 communicating with the fuel passage 2006 becomes larger than a sum of a fuel pressure in the low pressure chamber 2601 and a pressure of the spring 2605, the fuel flow controlling member 2007 is moved upward (FIG. 31). On the other hand, if the fuel pressure in the high pressure chamber 2606 becomes smaller than the sum, the fuel flow controlling member 2007 is moved downward (FIG. 31). According to the present embodiment, the shape of the fuel spray can be changed by moving the fuel flow controlling member 2007 along the center axis L of the injector by a fuel supply means for supplying a fuel to the injector, without providing an another moving means for moving the fuel flow controlling member 2007.

Figure 32:
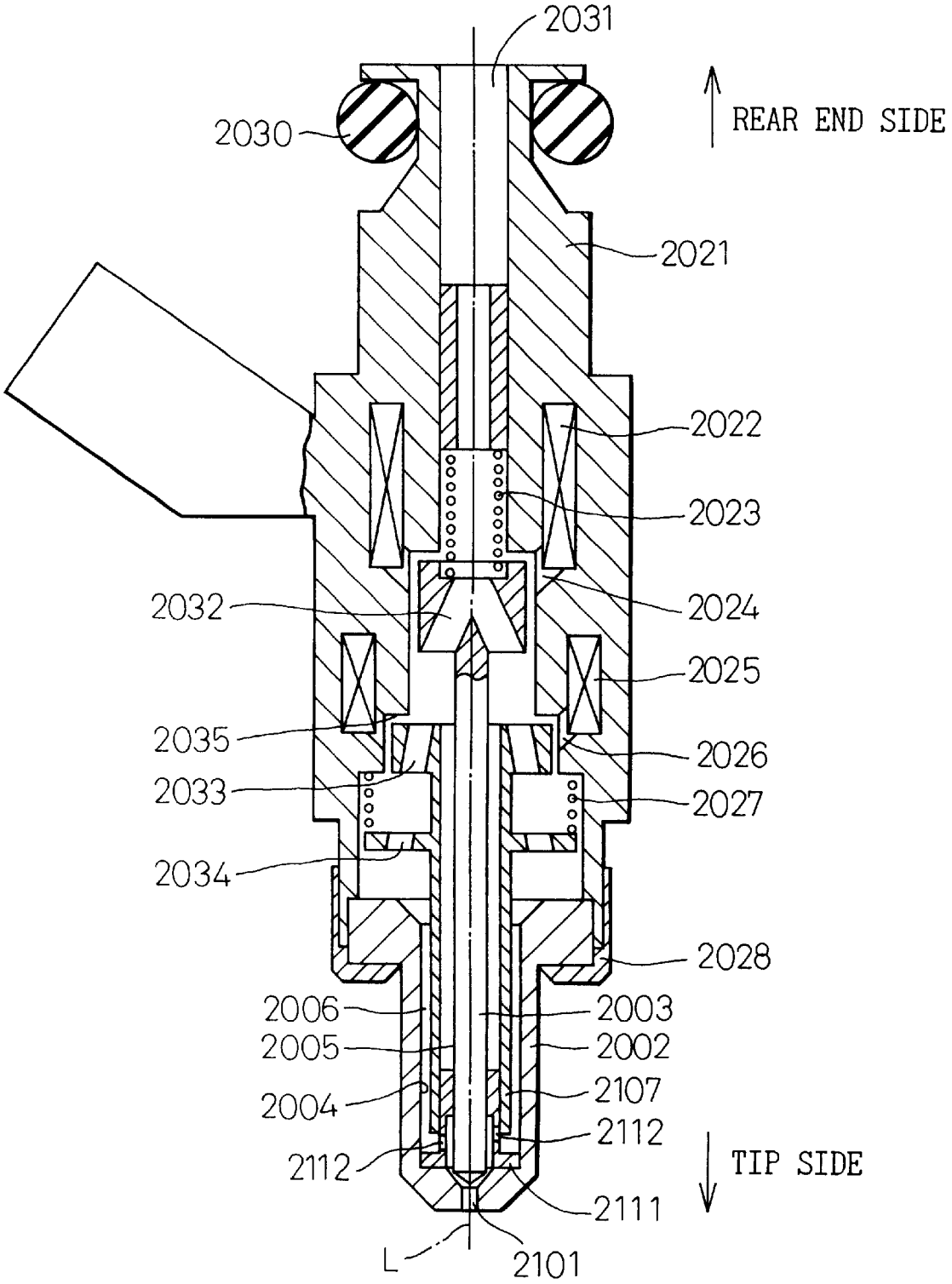
FIG. 32 is a partially sectional side view of a tenth embodiment of the injector of the present invention, the injector being applied to a direct injection type engine.
Figure 33:
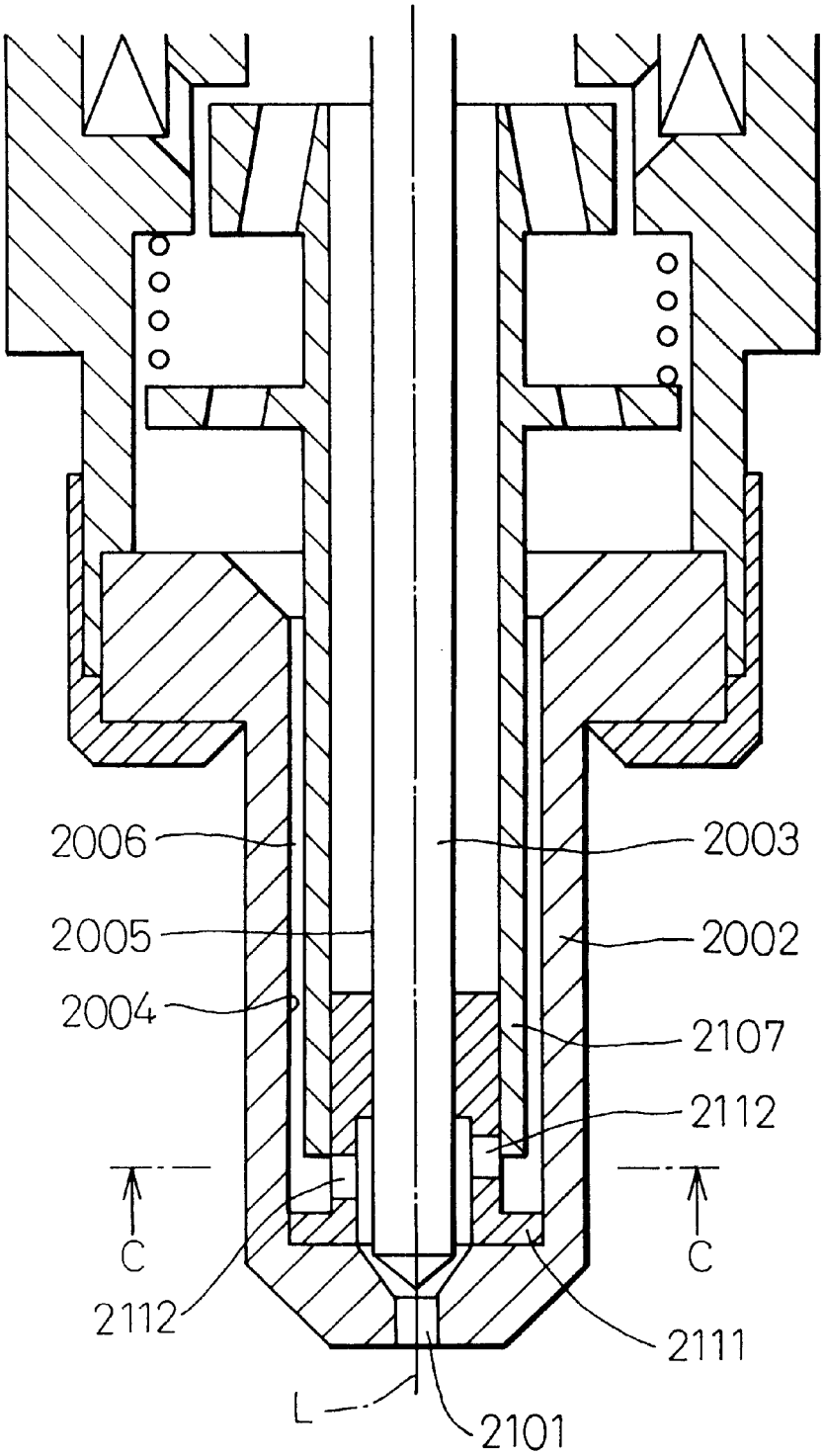
FIG. 33 is an enlarged view of FIG. 32.
Figure 34:
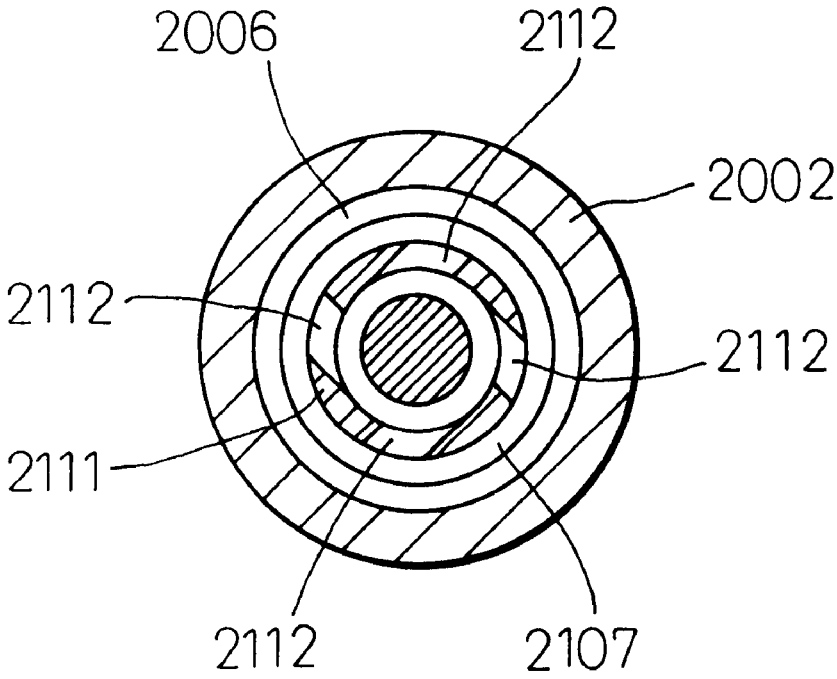
FIG. 34 is a sectional view cut along line C—C in FIG. 33.

FIG. 32 is a partially sectional side view of a tenth embodiment of an injector of the present invention, the injector being applied to a direct injection type engine. FIG. 33 is an enlarged view of FIG. 32. FIG. 34 is a sectional view cut along line C—C in FIG. 33. In FIGS. 32 to 34, numerals which are the same as the numerals shown in FIGS. 26, 27, 28A, 28B, 29A, 29B, 30A and 30B designate parts or portions which are the same as the parts or the portions shown in FIGS. 26, 27, 28A, 28B, 29A, 29B, 30A and 30B, numeral 2101 designates a cylindrical nozzle hole, and numeral 2107 designates a cylindrical fuel flow controlling member located on a tip side of the valve body 2003 in the fuel passage 2006 for controlling the fuel flow in the fuel passage 2006. Numeral 2111 designates a swirl collar, and numeral 2112 designates a swirl hole formed in the swirl collar 2111.

According to the present embodiment, the fuel flow controlling member 2107 in the fuel passage 2006 defined by the injection nozzle inner surface 2004 and the valve body outer surface 2005 is moved along the center axis L of the injector. Therefore, a blocked area wherein the swirl hole 2112 is blocked with the fuel flow controlling member 2107 is changed, and the fuel flow in the fuel passage 2006 is changed. Accordingly, the shape of the fuel spray is changed. That is, even if the lift amount of the valve body 2003 is not changed, the fuel flow through the fuel passage 2006 and the cylindrical nozzle hole 2101 can be changed by moving the fuel flow controlling member 2107 along the center axis L of the injector, and therefore, the shape of the fuel spray can be changed.

Further, according to the present embodiment, the fuel flow controlling member 2107 is moved in order that the cross section of the fuel passage is decreased to the cross section of the nozzle hole. Therefore, the fuel injection rate can be decreased. For example, even if the fuel injection period cannot be decreased, the fuel injection amount can be decreased. Also, according to the present embodiment, the cylindrical fuel flow controlling member 2107 is moved in a moving direction of the valve body 2003, i.e., is moved in a direction which is the same as a direction of the center axis L of the injector. Therefore, the shape of the fuel spray can be changed by making the fuel flow into the cylindrical nozzle hole 2101 circumferentially non-uniform when the lift amount of the cylindrical fuel flow controlling member 2107 is made small, and by making the fuel flow into the cylindrical nozzle hole 2101 circumferentially relatively uniform when the lift amount of the cylindrical fuel flow controlling member 2107 is made large and the swirl hole 2112 is not blocked with the fuel flow controlling member 2107.

Moreover, according to the present embodiment, since a fuel return passage is not required, the injector can be simpler. Further, since the fuel flow controlling member 2107 is not rotated but is directly moved, a controlling response of the fuel flow controlling member 2107 becomes faster than if the fuel flow controlling member is rotated.

Although the fuel flow controlling member 2107 is moved by the second solenoid 2025 in the present embodiment, in another embodiment, a fuel flow controlling member may be moved by changing a fuel supply pressure as in the embodiment shown in FIG. 31. According to this embodiment, the shape of the fuel spray can be changed by moving the fuel flow controlling member 2107 along the center axis L of the injector by a fuel supply means for supplying a fuel to the injector, without providing an another moving means for moving the fuel flow controlling member 2107.

Figure 35:
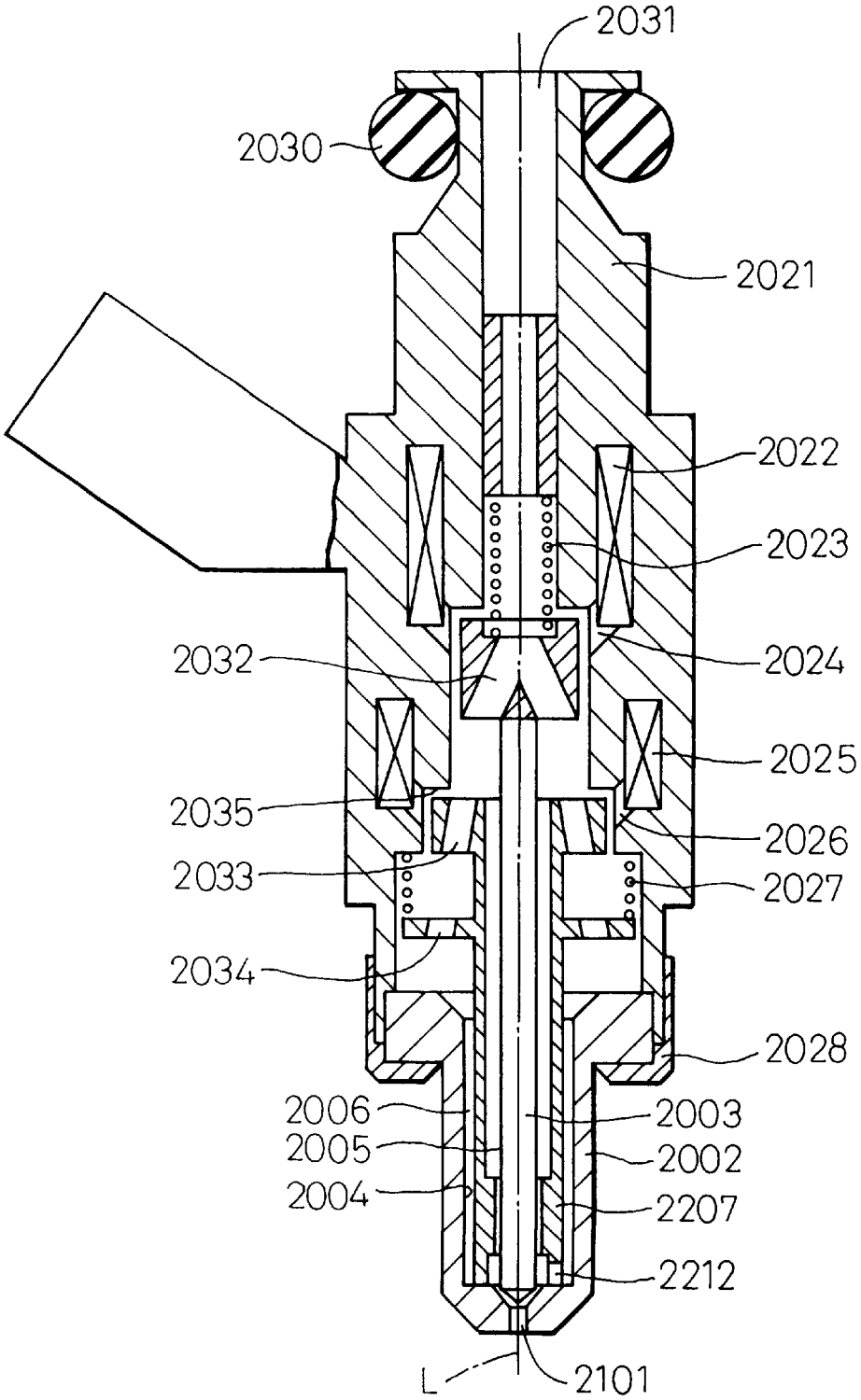
FIG. 35 is a partially sectional side view of an eleventh embodiment of the injector of the present invention, the injector being applied to a direct injection type engine.
Figure 36:
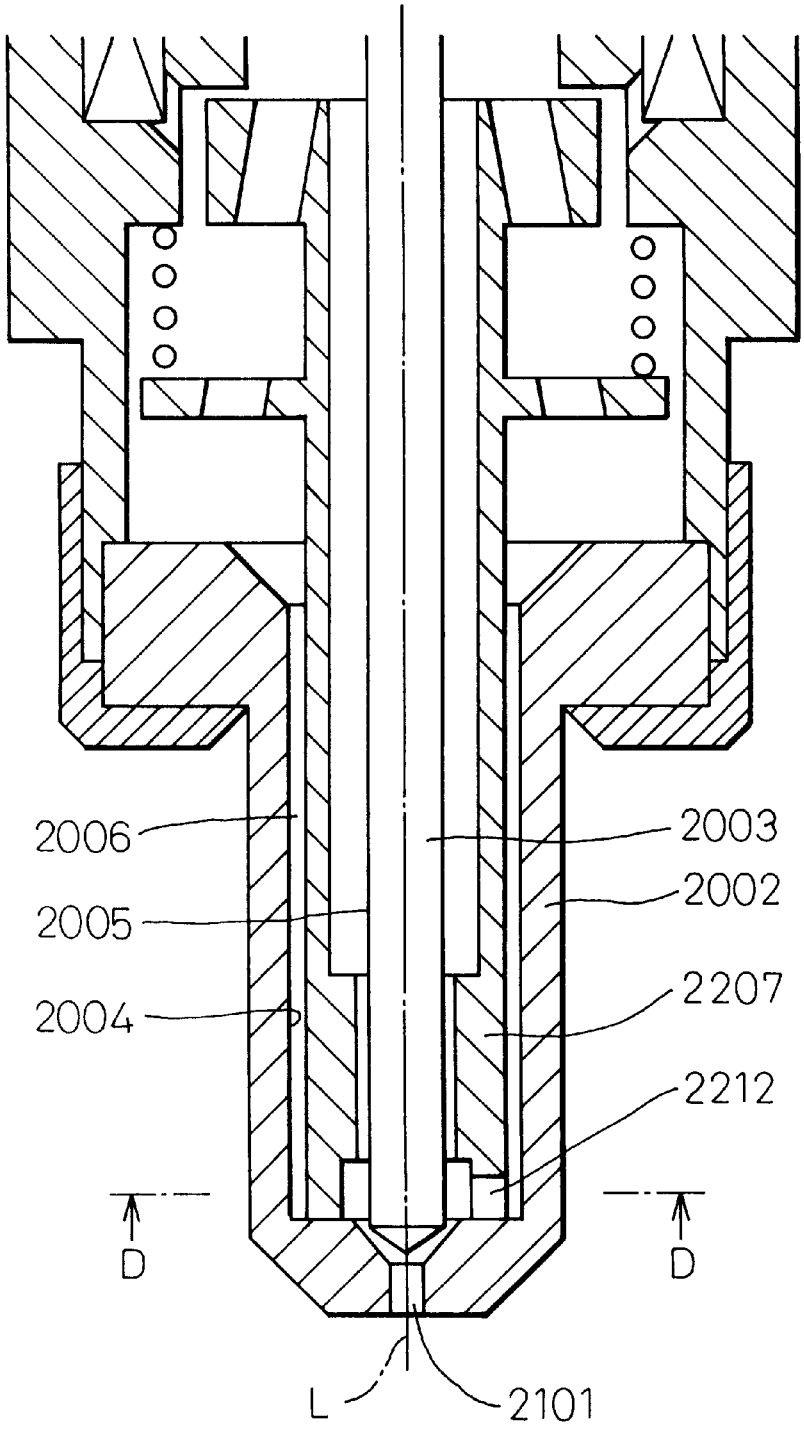
FIG. 36 is an enlarged view of FIG. 35.
Figure 37:
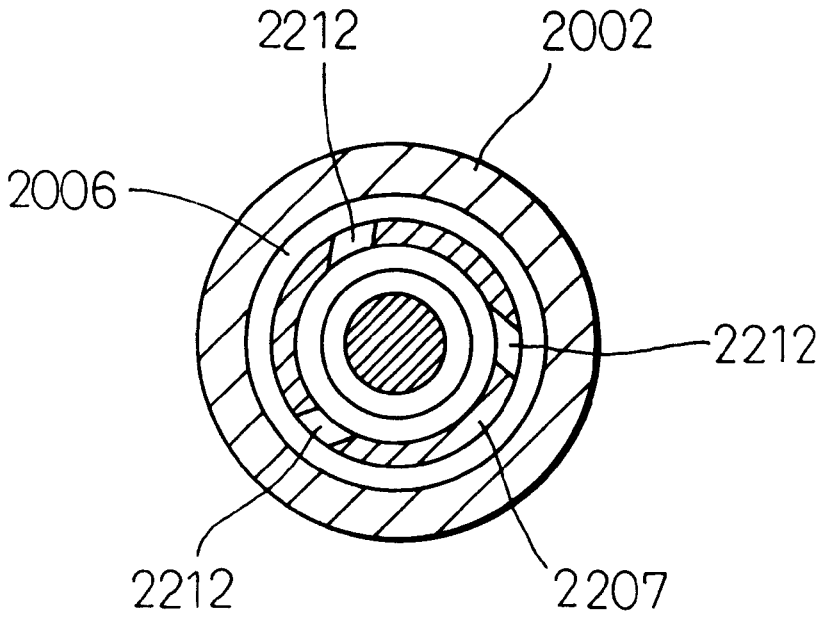
FIG. 37 is a sectional view cut along line D—D in FIG. 36.

FIG. 35 is a partially sectional side view of an eleventh embodiment of an injector of the present invention, the injector being applied to a direct injection type engine. FIG. 36 is an enlarged view of FIG. 35. FIG. 37 is a sectional view cut along line D—D in FIG. 36. In FIGS. 35 to 37, numerals which are the same as the numerals shown in FIGS. 26 to 34 designate parts or portions which are the same as the parts or the portions shown in FIGS. 26 to 34, numeral 2207 designates a cylindrical fuel flow controlling member located on a tip side of the valve body 2003 in the fuel passage 2006 for controlling the fuel flow in the fuel passage 2006, and numeral 2212 designates a swirl groove formed on a tip of the fuel flow controlling member 2207 for forming a swirl flow.

According to the present embodiment, the fuel flow controlling member 2207 in the fuel passage 2006 defined by the injection nozzle inner surface 2004 and the valve body outer surface 2005 is moved along the center axis L of the injector. Therefore, the fuel flow in the fuel passage 2006 is changed. Accordingly, the shape of the fuel spray is changed. That is, even if the lift amount of the valve body 2003 is not changed, the fuel flow through the fuel passage 2006 and the cylindrical nozzle hole 2101 can be changed by moving the fuel flow controlling member 2207 along the center axis L of the injector, and therefore, the shape of the fuel spray can be changed.

Further, according to the present embodiment, the cylindrical fuel flow controlling member 2207 which is movable independently of the valve body 2003 is located on the tip side of the valve body 2003 in the fuel passage 2006, and at least one swirl groove 2212 for communicating with the outer periphery and the inner periphery of the cylindrical fuel flow controlling member 2207 is located a tip of the cylindrical fuel flow controlling member 2207. Therefore, the fuel flow in the fuel passage 2006 can be changed by moving the cylindrical fuel flow controlling member 2007 having the swirl groove 2212 in the fuel passage 2006. Accordingly, the shape of the fuel spray can be changed. That is, even if the lift amount of the valve body 2003 is not changed, the injector can change the fuel flow in the fuel passage 2006 and the cylindrical nozzle hole 2101 and change the shape of the fuel spray by moving the cylindrical fuel flow controlling member 2207 which is movable independently of the valve body 2003. Further, since the cylindrical fuel flow controlling member 2207 is located on the tip side of the valve body 2003 in the fuel passage 2006, and the swirl groove 2212 is located at the tip of the cylindrical fuel flow controlling member 2207, the fuel which flows through the cylindrical nozzle hole 2101 is more advantageously changed, and therefore, the shape of the fuel spray can be changed.

Particularly, when the fuel flow controlling member 2207 is not lifted, all of the fuel which flows from the inside of the fuel flow controlling member 2207 to outside thereof flows through the swirl groove 2212, and therefore, the fuel which flows through the nozzle hole 2101 forms a swirl. Accordingly, the fuel spray divergent angle becomes relatively large. On the other hand, when the fuel flow controlling member 2207 is lifted and a gap is formed between a tip of the fuel flow controlling member 2207 and the injection nozzle 2202, a part of the fuel which flows from the inside of the fuel flow controlling member 2207 to the outside thereof flows through the swirl groove 2212, the other part of the fuel does not flow through the swirl groove 2212 but flows through the gap. Therefore, the swirl which is formed by the fuel which flows through the nozzle hole 2101 becomes weak. Accordingly, the fuel spray divergent angle becomes smaller than if the fuel flow controlling member 2207 is not lifted.

According to the present embodiment, the fuel flow controlling member 2207 is moved such that a cross section of the fuel passage is decreased to a cross section which is substantially the same as a cross section of the nozzle hole 2101, i.e., the tip of the fuel flow controlling member 2207 is abutted against the injection nozzle 2002. Therefore, the fuel injection rate can be decreased. For example, even if the fuel injection period cannot be decreased, the fuel injection amount can be decreased.

Although the fuel flow controlling member 2207 is moved by the second solenoid 2025 in the present embodiment, in another embodiment, a fuel flow controlling member may be moved by changing a fuel supply pressure like as the embodiment shown in FIG. 31. According to this embodiment, the shape of the fuel spray can be changed by moving the fuel flow controlling member 2207 along the center axis L of the injector by a fuel supply means for supplying a fuel to the injector, without providing an another moving means for moving the fuel flow controlling member 2207.

While the above description constitutes the preferred embodiment of the present invention, it will be appreciated that the invention is susceptible to modification, variation and change without departing from the proper scope and fair meaning of the accompanying claims.

What is claimed is:

1. An injector, comprising:

an injection nozzle having a nozzle hole;

a valve body for controlling a fuel flow through the nozzle hole;

changing means for changing a shape of a fuel spray, the fuel spray being formed by the fuel which flows through the nozzle hole; and rotation preventing means for preventing the valve body from rotating with respect to the injection nozzle around a center axis of the valve body, wherein the rotation preventing means prevents the valve body from rotating with respect to the injection nozzle when the rotation of the valve body with respect to the injection nozzle should be prevented, and the valve body is allowed to rotate with respect to the injection nozzle around the center axis of the valve body when the rotation preventing means does not prevent the valve body from rotating with respect to the injection nozzle.

2. An injector according to claim 1, further including angular displacement controlling means for controlling an angular displacement of the valve body with respect to the injection nozzle.

3. An injector according to claim 2, wherein a shape of a tip of the valve body is circumferentially non-uniform.

4. An injector according to claim 3, wherein the tip of the valve body has two surfaces which are parallel to the center axis of the valve body and are parallel each other, and wherein the nozzle hole is a slit.

5. An injector according to claim 3, wherein the tip of the valve body is non-uniformly formed with respect to the center axis of the valve body.

6. An injector, comprising:

an injection nozzle having a nozzle hole;

a valve body for controlling a fuel flow through the nozzle hole; and changing means for changing a shape of a fuel spray, the fuel spray being formed by the fuel which flows through the nozzle hole, wherein the center axis of the valve body is allowed to be eccentrically located with respect to a center axis of the injection nozzle, and wherein the injector further comprises eccentricity controlling means for controlling an eccentricity of the center axis of the valve body with respect to the center axis of the injection nozzle.

7. An injector according to claim 6, further including a first position in which the center axis of the valve body is eccentrically located with respect to the center axis of the injection nozzle, a second position in which the center axis of the valve body is concentrically located with respect to the center axis of the injection nozzle, and a third position in which the center axis of the valve body is located on the opposite side of the center axis of the injection nozzle from the first position.

8. An injector, comprising:

an injection nozzle having a nozzle hole;

a valve body for controlling a fuel flow through the nozzle hole; and changing means for changing a shape of a fuel spray, the fuel spray being formed by the fuel which flows through the nozzle hole, wherein the valve body includes an inner member with a tip and an outer member located outside of the inner member, and wherein a relative position of the tip with respect to the outer member during the valve opening period is decided on the basis of a target fuel spray to be injected, and then the tip is positioned to the decided position.

9. An injector, comprising:

an injection nozzle having a nozzle hole;

a valve body for controlling a fuel flow through the nozzle hole; and changing means for changing a shape of a fuel spray, the fuel spray being formed by the fuel which flows through the nozzle hole, wherein the valve body includes an inner member with a tip and an outer member located outside of the inner member, and wherein the changing means includes selecting means for selecting a protruding amount of the tip with respect to the outer member during the valve opening period.

10. An injector according to claim 9, wherein the outer member is hollow over its full length, and the selecting means is located on the opposite side of the inner member from the tip and outside of the outer member.

11. An injector, comprising:

an injection nozzle having a nozzle hole;

a valve body for controlling a fuel flow through the nozzle hole; and changing means for changing a shape of a fuel spray, the fuel spray being formed by the fuel which flows through the nozzle hole, wherein the changing means changes the shape of fuel spray by changing a shape of the nozzle hole on the basis of a lift amount of the valve body.

12. An injector according to claim 11, wherein the valve body is hollow in order that a fuel to be injected can flow inside of the hollow valve body, and the valve body has a through opening of the valve body in order that the fuel which flows inside of the hollow valve body can flow out of the hollow valve body, and the injection nozzle has a through opening of the injection nozzle in order that the fuel which flows through the through opening of the valve body can flow out of the injector, and wherein the nozzle hole is defined by an overlapping area of the through opening of the valve body and the through opening of the injection nozzle.

13. An injector, comprising:

an injection nozzle having a nozzle hole;

a valve body for controlling a fuel flow through the nozzle hole; and changing means for changing a shape of a fuel spray, the fuel spray being formed by the fuel which flows through the nozzle hole, wherein the nozzle hole is a slit, and the valve body is hollow, and the valve body has a first opening placed downstream with respect to a fuel seal portion in order that the fuel to be injected can flow into the valve body, and a second opening placed downstream with respect to the first opening in order that the fuel which flows into the valve body can flow out of the valve body, and wherein an upstream width of the second opening is smaller than an downstream width of the second opening and smaller than a width of the slit, and as a lift amount of the valve body increases, an overlapping area of the slit and the second opening increases, and after a valve opening motion is completed, a minimum cross section of a fuel passage is defined by the first opening and is kept constant.

14. An injector according to claim 13, wherein the width of the second opening becomes gradually smaller as a position in which the width of the second opening is measured shifts from downstream to upstream.

15. An injector according to claim 13, wherein an intersection point of an extension line from a surface of a left side wall of the second opening and an extension line from a surface of a right side wall of the second opening is located on the opposite side of a center line of the valve body from the second opening, in the cross sectional view of the second opening.

16. An injector, comprising:

an injection nozzle having a nozzle hole;

a valve body for controlling a fuel flow through the nozzle hole; and changing means for changing a shape of a fuel spray, the fuel spray being formed by the fuel which flows through the nozzle hole, wherein a fuel passage is defined by an inner periphery of the injection nozzle and an outer periphery of the valve body, and a fuel flow controlling member is located in the fuel passage, and wherein the fuel flow controlling member is moved along a center axis of the injector in order that the fuel flow can be changed in the fuel passage.

17. An injector according to claim 16, wherein the fuel flow controlling member is moved such that a cross sectional area of the fuel passage is decreased to a cross sectional area of the nozzle hole in order to decrease a rate of fuel injection.

18. An injector according to claim 16, wherein fuel supply pressure with respect to the injector is changed in order to move the fuel flow controlling member along the center axis of the injector.

19. An injector according to claim 16, wherein a tip of the fuel flow controlling member is comprised of a seal portion and a notch portion, and a shape of the tip of the fuel flow controlling member is asymmetric.

20. An injector, comprising an injection nozzle having a nozzle hole;

a valve body for controlling a fuel flow through the nozzle hole; and changing means for changing a shape of a fuel spray, the fuel spray being formed by the fuel which flows through the nozzle hole, wherein a fuel passage is defined by an inner periphery of the injection nozzle and an outer periphery of the valve body, and a cylindrical member is located on a tip side of the valve body in the fuel passage, and wherein the cylindrical member is movable independently of the valve body, and at least one communicating portion for communicating with an outer periphery and an inner periphery of the cylindrical member is located at a tip portion of the cylindrical member, and the cylindrical member is moved in the same direction as a moving direction of the valve body in order to change the fuel flow in the fuel passage.

* * * * *